United States Patent [19]

Hunter

[11] Patent Number: 4,840,218

[45] **Date of Patent: * Jun. 20, 1989**

[54] AUTOMATIC MATCHPLATE MOLDING SYSTEM

[75] Inventor: William A. Hunter, Inverness, Ill.

[73] Assignee: Hunter Automated Machinery Corporation, Schaumburg, Ill.

[ * ] Notice: The portion of the term of this patent subsequent to Oct. 13, 2004 has been disclaimed.

[21] Appl. No.: 33,177

[22] Filed: Apr. 1, 1987

[51] Int. Cl.[4] ..... B22C 15/22; B22C 15/28

[52] U.S. Cl. ..... 164/169; 164/182; 164/187; 164/193; 164/201

[58] Field of Search ..... 164/169, 182, 187, 207, 164/192, 193, 194, 195, 200, 201, 202

[56] References Cited

U.S. PATENT DOCUMENTS

| | | | |
|---|---|---|---|
| 3,229,336 | 1/1966 | Hunter et al. | 164/182 X |
| 3,238,575 | 3/1966 | Taccone | 164/169 |
| 3,406,738 | 10/1968 | Hunter | 164/182 |
| 3,433,285 | 3/1969 | Fellows | 164/193 |
| 3,506,058 | 4/1970 | Hunter | 164/37 |
| 3,520,348 | 7/1970 | Hunter | 164/193 |
| 3,589,432 | 6/1971 | Miller et al. | 164/182 |
| 3,744,549 | 7/1973 | Buhler | 164/202 X |
| 3,878,881 | 4/1975 | Lund et al. | 164/200 X |
| 4,114,677 | 9/1978 | Wernli | 164/194 X |
| 4,156,450 | 5/1979 | Hunter | 164/24 |
| 4,230,172 | 10/1980 | Uzaki et al. | 164/192 |
| 4,699,199 | 10/1987 | Hunter | 164/187 X |

FOREIGN PATENT DOCUMENTS

| | | | |
|---|---|---|---|
| 46-949 | 1/1971 | Japan | 164/207 |
| 53-52237 | 5/1978 | Japan | 164/195 |
| 54-38222 | 3/1979 | Japan | 164/169 |
| 55-22405 | 2/1980 | Japan | 164/207 |
| 56-30056 | 3/1981 | Japan | 164/207 |

*Primary Examiner*—Nicholas P. Godici
*Assistant Examiner*—J. Reed Batten, Jr.
*Attorney, Agent, or Firm*—Leydig, Voit & Mayer

[57] ABSTRACT

Green sand molds for use in casting operations are made automatically by a matchplate molding system. Features of the system include (1) pneumatic apparatus for filling the cope and drag flasks with sand, (2) a pusher on the drag flask for shifting molds of various shapes to a transfer conveyor, (3) a carriage supporting the drag flask for vertical and lateral movement, (4) a lower sand magazine which moves laterally to open and close a sand chute gate while also being movable vertically relative to the gate, (5) a squeeze head which moves between various positions enabling control over the volume of sand delivered to the cope and drag flasks, (6) a vibrator for directly vibrating the matchplates, (7) liners for releasably holding molds in the flasks, (8) an accumulating conveyor for transferring the newly formed molds and (9) a pusher for shoving the molds off of the accumulating conveyor.

8 Claims, 18 Drawing Sheets

AUTOMATIC MATCHPLATE MOLDING SYSTEM

BACKGROUND OF THE INVENTION

The present invention relates to automated matchplate molding systems for forming green sand molds for use in foundries. Prior art systems for this purpose are disclosed in Hunter U.S. Pat. No. 3,406,738 for "Automatic Matchplate Molding Machine"; Hunter U.S. Pat. No. 3,506,058 for "Method of Matchplate Moulding"; Hunter U.S. Pat. No. 3,520,348 for "Fill Carriages for Automatic Matchplate Moulding Machines"; and Hunter U.S. Pat. No. 4,156,450 for "Foundry Machine and Method and Foundry Mold Made Thereby".

SUMMARY OF THE INVENTION

It is the general aim of the present invention to provide a relatively trouble-free matchplate molding system which is capable of making and handling molds of high quality at high speeds.

To achieve the foregoing, the invention contemplates the provision of a unique matchplate molding system incorporating several advantageous features which will become apparent from the detailed description of the system.

DETAILED DESCRIPTION OF THE PREFERRED EMBODIMENT

Figure 1:
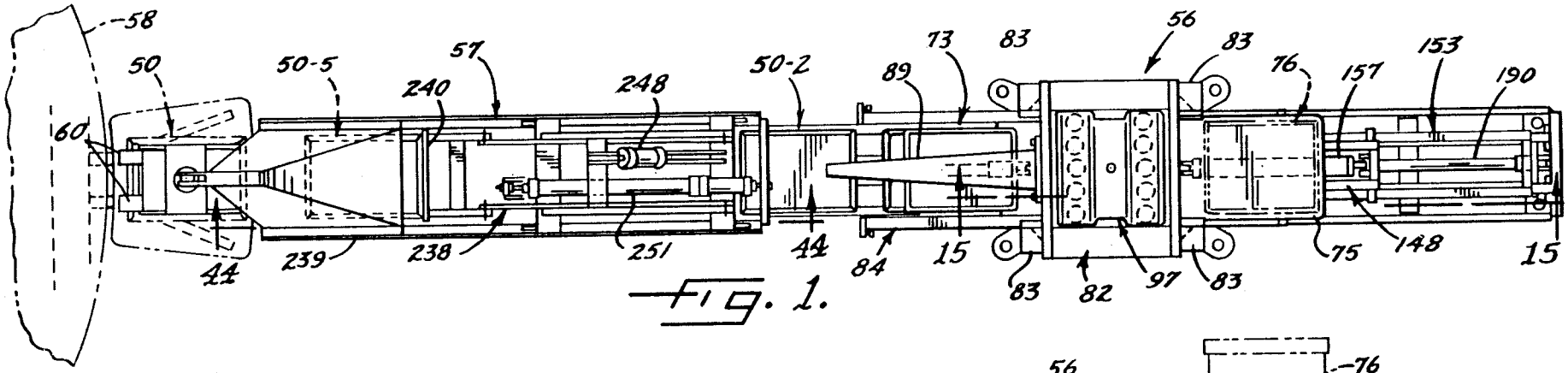
FIG. 1 is a top plan view of a new and improved matchplate mold making system incorporating the unique features of the present invention.

For purposes of illustration, the present invention is shown in the drawings as embodied in a matchplate molding system for making and handling green sand molds 50 (FIG. 3) of the type used by foundries to form metal castings. Each overall mold typically includes an upper cope mold 51 and a lower drag mold 52 abutting one another at a parting line 53 and defining a particularly shaped cavity 54 into which molten metal is poured through a sprue 55 in the cope mold.

Figure 2:
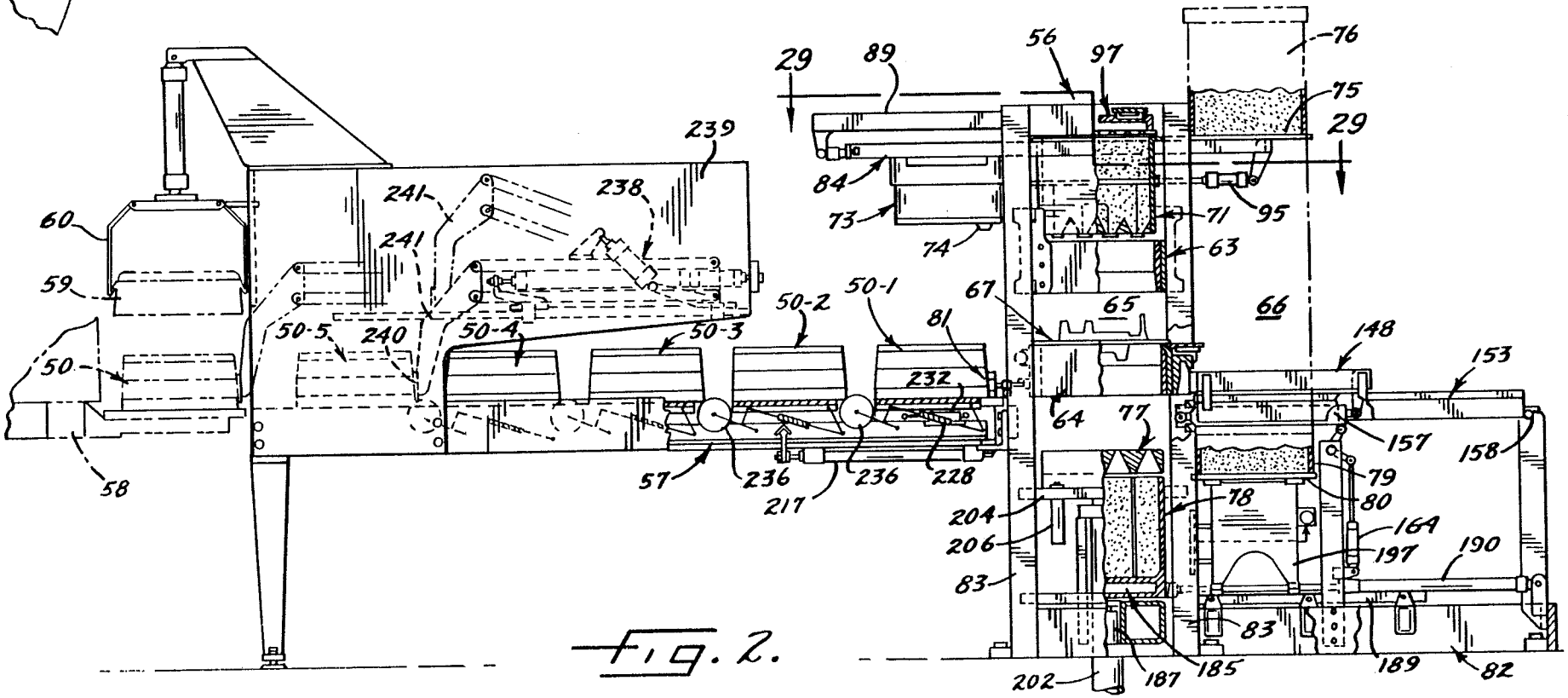
FIG. 2 is a side elevational view of the system shown in FIG. 1, certain parts being broken away and shown in section.
Figure 3:
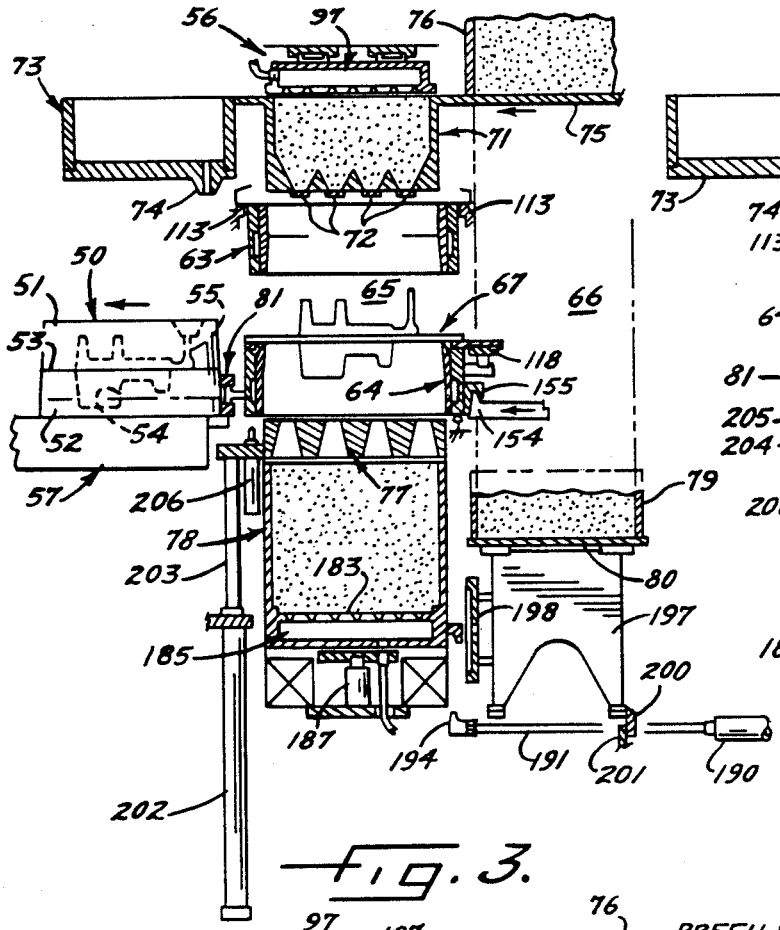
FIGS. 3 to 14 are schematic views showing successive steps involved in making a mold with the system of the present invention.

In general, the system includes a mold making section 56 where the molds 50 are formed and a conveyor 57 for transferring the molds to a rotary mold handling table 58 on which the molds are poured and cooled. As each mold 50 arrives at the turntable 58, a weighted casting jacket 59 (FIG. 2) is placed on the mold by a vertically reciprocable tong unit 60. To facilitate use of the casting jacket, the cope mold 51 tapers upwardly as shown in FIG. 3. Also, the drag mold 52 includes an upwardly tapered upper section 61(FIG. 32) and a vertical lower section 62.

To help gain an understanding of the mold making section 56, its principal components first will be described broadly along with the sequence of steps which are followed to make a mold 50. The various components of the mold making section then will be described in more detail.

Generally speaking, the mold making section 56 includes cope and drag flasks 63 and 64 in which the cope and drag molds 51 and 52, respectively, are formed. The cope flask always remains located laterally in a molding station 65 while the drag flask is adapted to shuttle laterally back and forth between the molding station and a sand filling station 66 located to the right of the molding station.

A matchplate 67 (FIG. 16) is adapted to be located between the flasks 63 and 64 and carries cope and drag patterns 68 and 69 which coact to form the cavity 54 in the ultimate mold 50. The cope pattern 68 includes a vertically extending finger 70 which defines part of the gate or sprue 55 in the mold.

Located above the cope flask 63 is a box-like structure which defines an upper sand magazine 71 whose lower end is adapted to be opened and closed by four laterally movable gates 72. An upper squeeze head 73 with a sprue former 74 (FIG. 3) is located to the left of the sand magazine while a sand gate 75 is located to the right of the magazine. The sand magazine 71 is normally located in the molding station 65 while the gate 75 normally closes the lower end of an upper sand chute 76 located in the filling station 66. When the magazine is shifted to the right from the position shown in FIG. 3, the gate opens the chute to allow sand to fall into the magazine. At the same time, the upper squeeze head 73 is moved to the right and into the molding station 65.

A lower squeeze head 77 and a lower sand magazine 78 are located below the drag flask 64. The drag flask 64, the lower squeeze head 77 and the lower sand magazine 78 are supported to move upwardly and downwardly in the molding station 65 and, in addition, the sand magazine and the drag flask may shift laterally back and forth between the molding station and the filling station 66. Upon being shifted to the filling station 66, the lower sand magazine moves to a receiving position beneath a lower sand chute 79 and, at the same time, a gate 80 is moved to the right to permit sand to discharge from the lower sand chute and fill the lower magazine. When the lower sand magazine returns leftwardly toward the molding station to a sand delivery position, the gate 80 recloses the lower sand chute 79.

FIG. 3 shows the various components of the mold making section 56 in the positions such components occupy at the start of a cycle and just after a newly formed mold 50 has been formed and has been ejected from the mold making section. When the components are disposed as shown in FIG. 3, the upper sand magazine 71 is loaded with sand and is located in the molding station 65 with its gates 72 closed. The upper squeeze head 73 is located to the left of the molding station while the gate 75 is located to the right of the magazine in position to close off the upper sand chute 76. The cope flask 63 is spaced slightly below and is alined vertically with the magazine 71 and is spaced above the matchplate 67. The latter is supported by the drag flask 64, which is held at a fixed elevation in vertical alinement with the cope flask. The lower squeeze head 77 is in an inactive position spaced just below the drag flask 74 and is closely adjacent the upper end of the lower sand magazine 78, which is loaded with sand. Sand is prevented from discharging out of the lower sand chute 79 by the gate 80.

Figure 4:
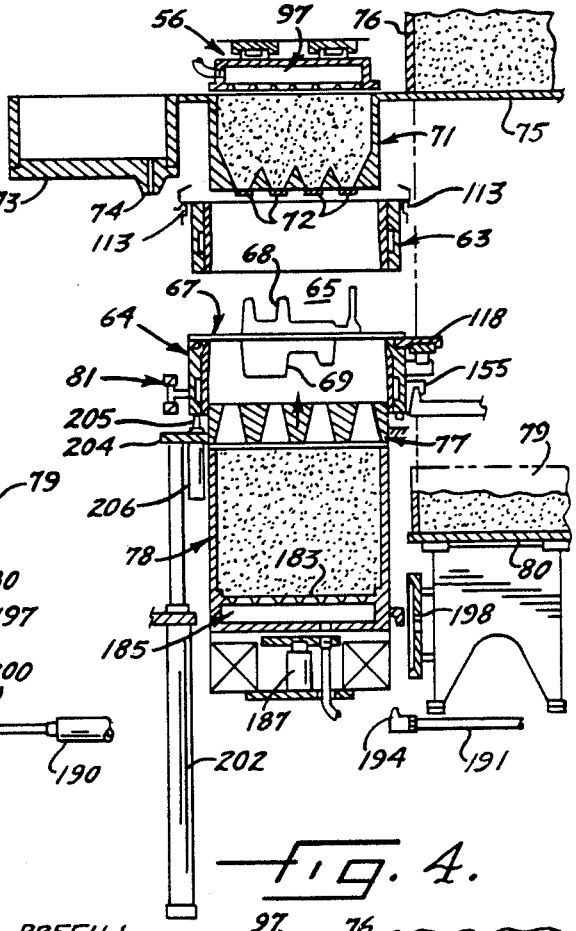

A molding cycle is initiated by raising the lower squeeze head 77 and the lower sand magazine 78 upwardly to cause the squeeze head to move to a prefill position and telescope upwardly into the lower end portion of the drag flask 64 as shown in FIG. 4. The distance the squeeze head telescopes upwardly into the drag flask to the prefill position is controlled so as to enable control of the volume of sand which subsequently is loaded into the flask.

Figure 5:
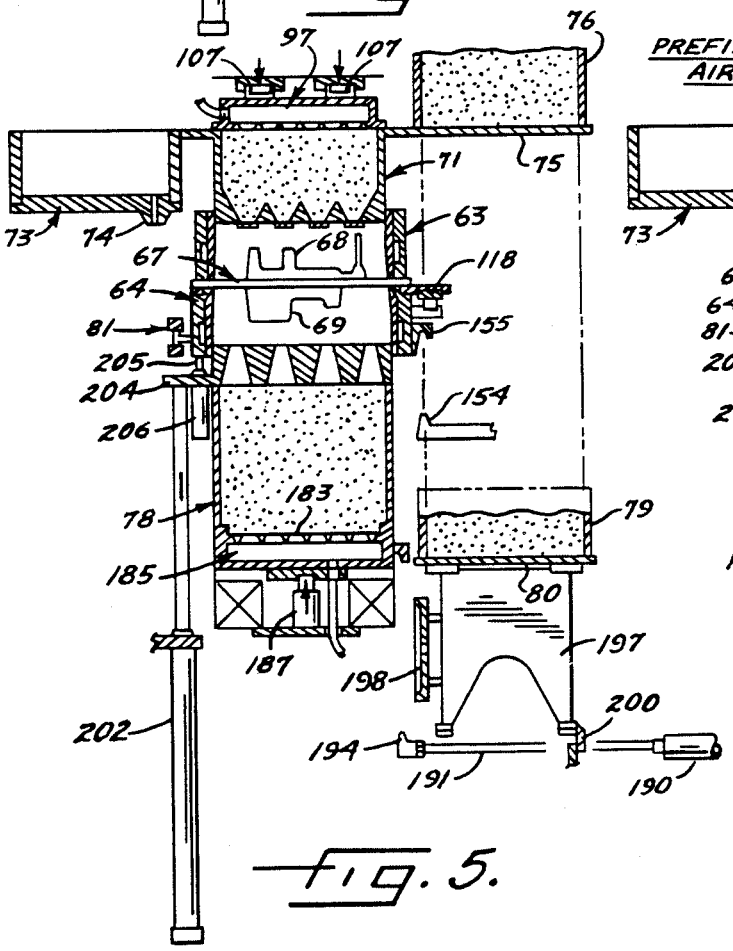

Thereafter, the lower sand magazine 78, the lower squeeze head 77, the drag flask 64 and the matchplate 67 are moved upwardly as a unit (see FIG. 5). As an incident thereto, the matchplate engages and raises the cope flask 63 so as to cause the upper end portion of the cope flask to telescope over the lower end portion of the upper sand magazine 71. The distance the cope flask 63 telescopes over the magazine 71 is controlled so as to enable control of the volume of sand which later is discharged into the cope flask.

Figure 6:
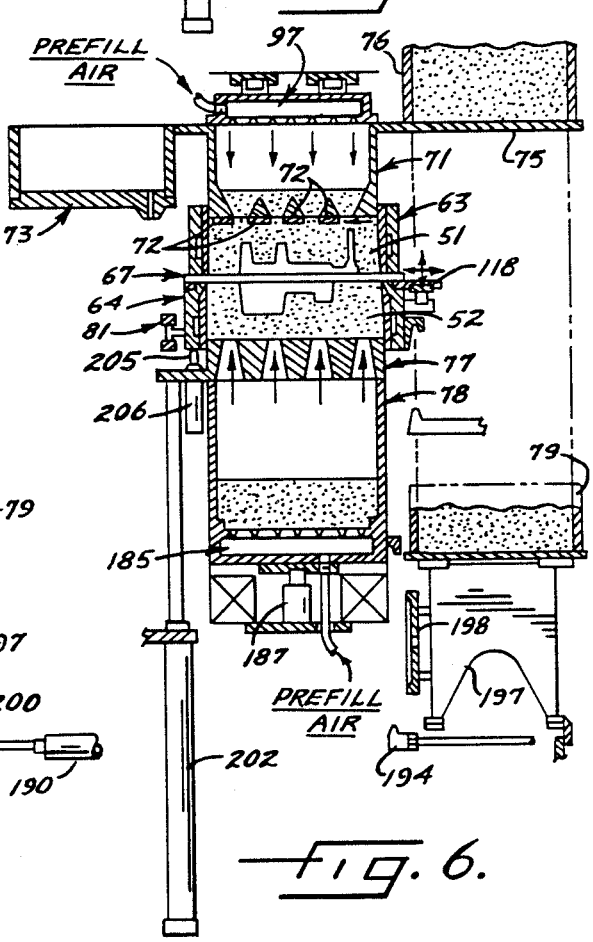

With the components thus positioned, the gates 72 of the upper sand magazine 71 are opened and pressurized air is injected downwardly into the upper sand magazine and upwardly into the lower sand magazine 78 (see FIG. 6). As a result, sand is discharged downwardly from the upper sand magazine to prefill the cope flask 63 and, at the same time, sand is blown upwardly from the lower magazine, through the lower squeeze head 77 to prefill the drag flask 64. At this time, the matchplate 67 is vibrated to cause the sand to fill in intimately around the patterns 68 and 69. The gates 72 are closed after sufficient time has elapsed for filling of the cope flask 63.

Figure 7:
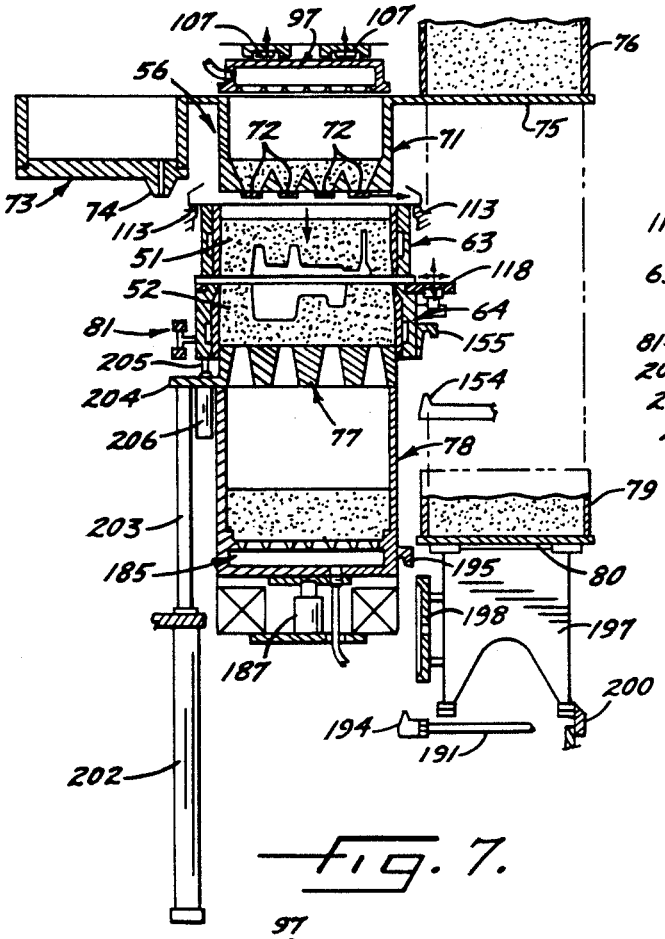

Thereafter, the lower sand magazine 78, the lower squeeze head 77 and the drag flask 64 are lowered slightly so as to enable the cope flask 63 to move downardly out of telescoping relation with the upper sand magazine 71 as shown in FIG. 7. The upper sand magazine 71 is shifted to the right out of the molding station 65 and toward the filling station 66 (see FIG. 8) and, as an incident thereto, the upper squeeze head 73 moves laterally into the molding station while the gate 75 moves to a position opening the upper sand chute 76. Accordingly, the upper sand magazine 71 is loaded with sand preparatory to the next cycle.

With the upper squeeze head 73 positioned in the molding station 65, all of the underlying components are raised so as to cause the cope flask 63 to telescope over the upper squeeze head and to cause the two squeeze heads 73 and 77 to coact to compact the sand tightly in the flasks 63 and 64 around the patterns 68 and 69, respectively, (see FIG. 9) and thereby form the molds 51 and 52. The sprue former 74 on the upper squeeze head 73 coacts with the finger 70 of the cope pattern 68 to form the sprue 55 in the cope mold 51. When the components are raised, the lower squeeze head moves to an active or compacting position in the drag flask 64 in order to compact the sand therein.

Figure 10:
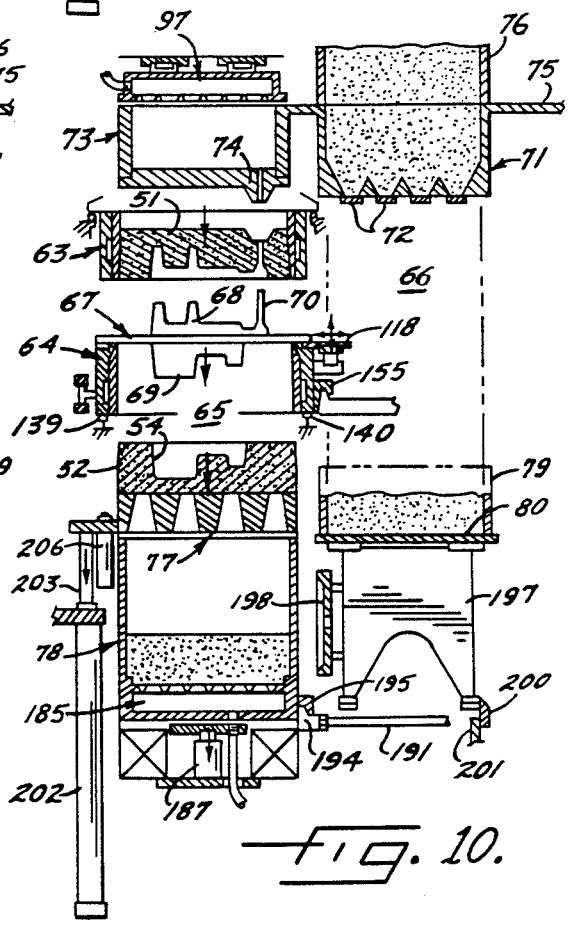

Once the sand has been compacted, the patterns 68 and 69 are drawn from the flasks 63 and 64 as shown in FIG. 10. This is achieved by first lowering the lower sand magazine 78, the lower squeeze head 77, the drag flask 64 and the cope flask 63 as a unit; by stopping the cope flask while continuing to lower the underlying components; and then by stopping the drag flask while continuing to lower the lower squeeze head and the lower sand magazine. As an incident to the steps, the pattern 68 is lowered out of the cope mold 51 in the cope flask 63 while the drag mold 52 is lowered out of the drag flask 64 and moves downwardly with the lower squeeze head 77 to a position clear of the drag flask.

Figure 11:
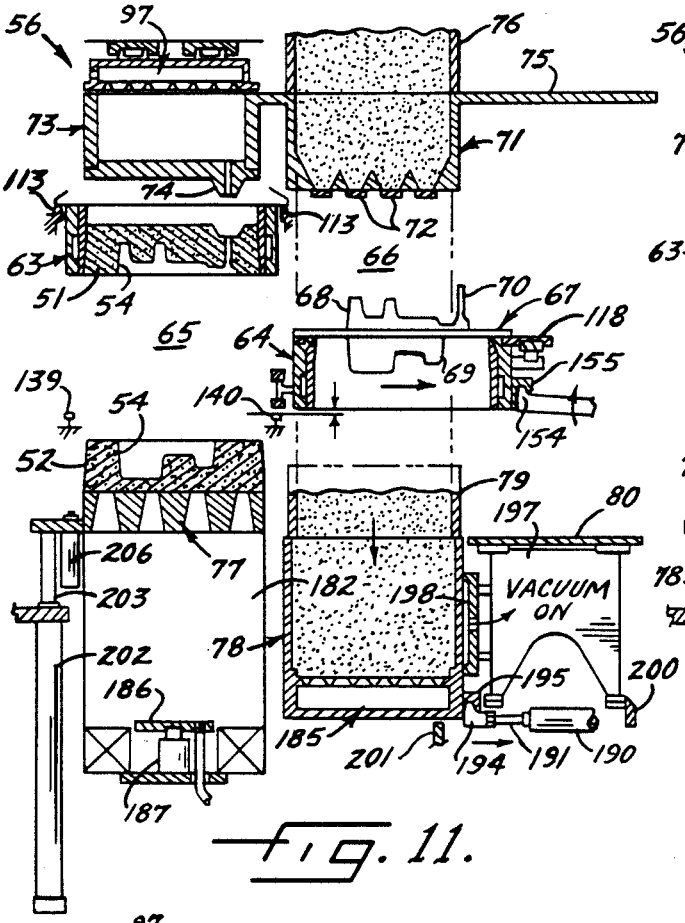
Figure 12:
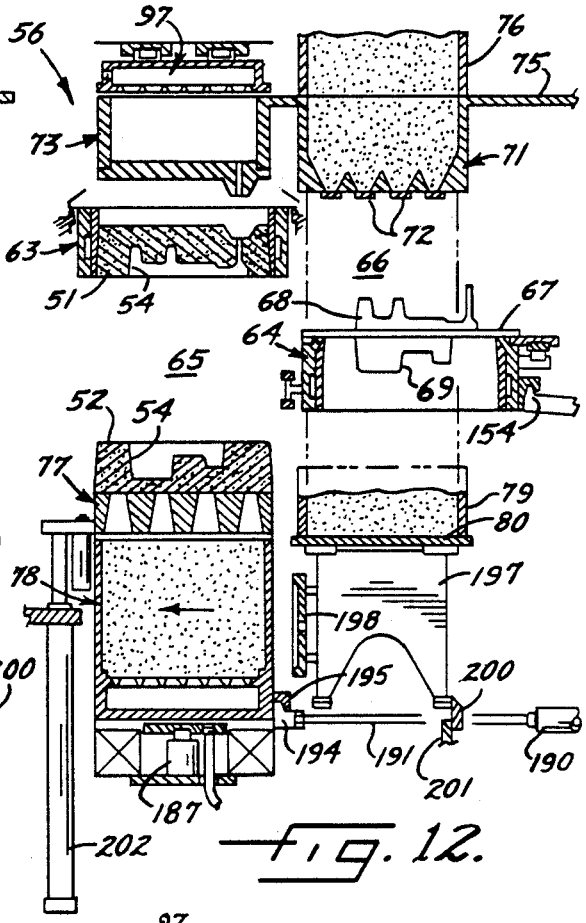

The drag flask 64 then is pulled out of the molding station 65 and is shifted to the right to a standby position in the filling station 66 as shown in FIG. 11. At the same time, the lower sand magazine 78 is pulled from beneath the lower squeeze head 77 and is shifted to the right to the filling station 66. During such shifting, the gate 80 moves to the right to open the lower sand chute 79 and enable sand to fill the lower sand magazine 78 preparatory to the next cycle. After the lower sand magazine 78 has been filled, it is returned back to the molding station 65 and to its original position beneath the lower squeeze head 77 as shown in FIG. 12. During such return, the gate 80 is shifted to a position re-closing the lower sand chute 79.

Figure 13:
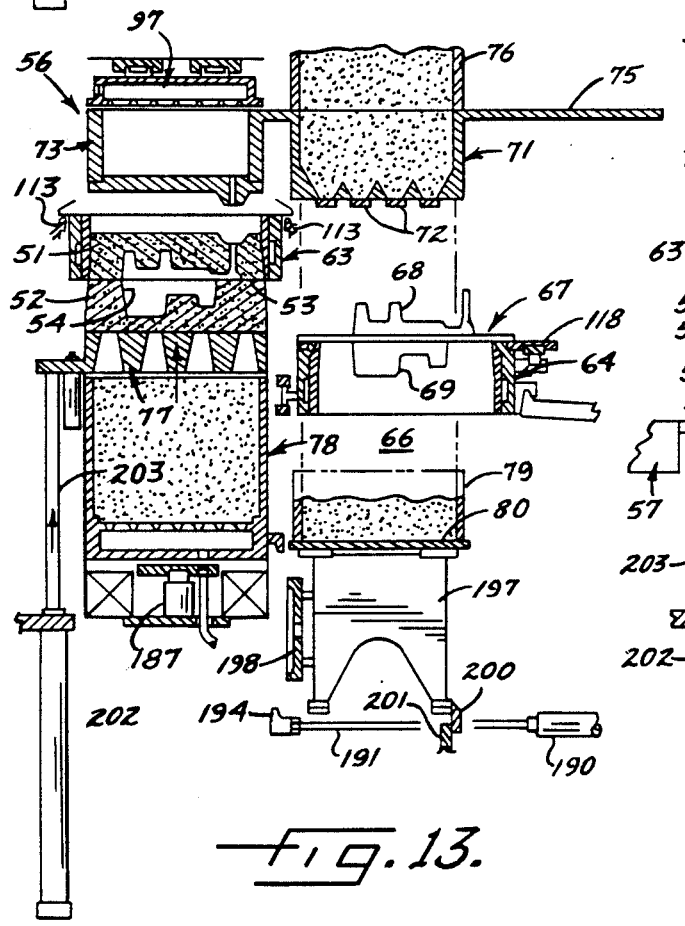

The next step involves shifting the lower sand magazine 78, the lower squeeze head 77, and the drag mold 52 upwardly to cause the upper side of the drag mold to engage the lower side of the cope mold 51 as shown in FIG. 13. As the drag mold 52 moves upwardly, it lifts the cope mold 51 and the cope flask 63 slightly to insure good contact of the two molds at the parting line 53. In other words, the weight of the cope mold and the cope flask during lifting creates a force which serves to close the joint between the two molds 51 and 52 and prevent metal from running out through the joint during the casting process.

Figure 14:
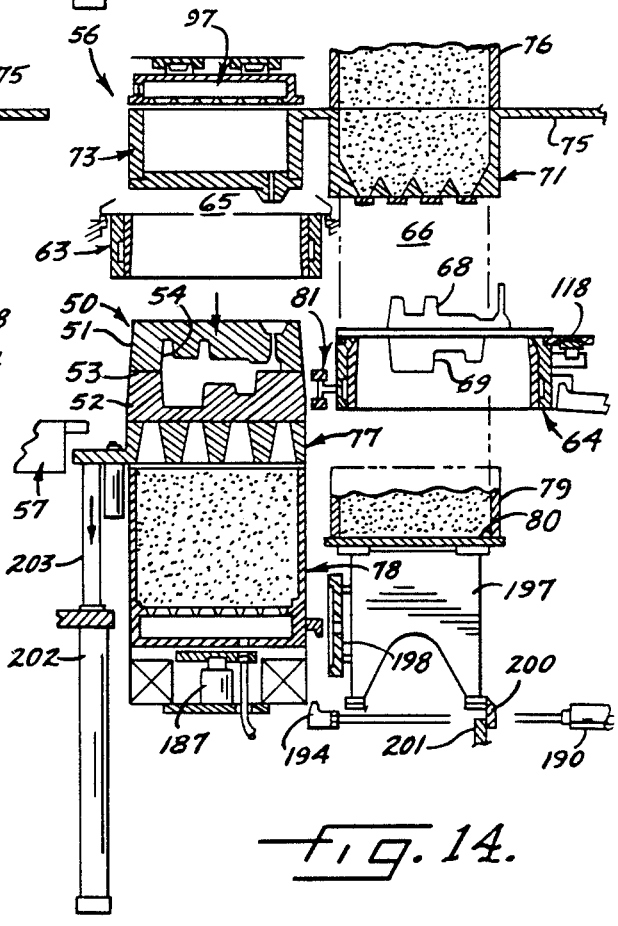

As the final steps in the mold making process, the cope mold 51 is released from the cope flask 63 and then the two molds 51 and 52 are lowered with the lower squeeze head 77 to a push-off position in which the bottom of the drag mold 52 is located at the same elevation as the transfer conveyor 57 (see FIG. 14). Thereafter, the drag flask 64 is shifted from right-to-left and is returned from its standby position to the molding station 65. During such return, a pusher 81 on the leading end of the drag flask shoves the completed mold 50 off of the lower squeeze head 77 and onto the transfer conveyor 57. When the drag flask completes its return to the molding station 65, the various components are positioned exactly as shown in FIG. 3 and are located for the start of the next cycle.

The construction of the mold making section 56 now will be described in detail. The mold making section includes several fixed frame members which are fastened together and which, taken together, form an overall main support that, for the most part, has simply been indicated generally by the reference numeral 82 (see FIG. 15). Four vertically extending and rigid columns 83 are fastened securely to the main support 82 and are located at the corners of an imaginary rectangle. The columns serve to guide and support the flasks 63 and 64 as the flasks are moved upwardly and downwardly through the various positions described previously.

Located adjacent the upper end portions of the columns 83 is a laterally movable carriage 84 (FIG. 29) defined by two laterally extending rails 85 which are interconnected by a cross rail 86. The carriage is guided on the main support 82 to move laterally back and forth and to effect lateral shifting of the upper squeeze head 73, the upper sand magazine 71 and the upper gate 75. As shown most clearly in FIG. 29, the upper squeeze head 73 is located between and is secured rigidly to the rails 85 of the carriage 84. A connecting bar 87 couples the upper squeeze head 73 to the upper magazine 71, and the latter also is supported rigidly between the rails 85. The upper gate 75 is attached to the magazine 71 and the rails 85 and is shifted laterally whenever the magazine and the upper squeeze head 73 are shifted. Such shifting is effected by a reciprocating hydraulic actuator 88 secured beneath an overhanging arm 89 of the main support 82 and having a rod 90 which is connected to the upper squeeze head 73 at 91. When the rod 90 of the actuator 88 is extended, it acts through the upper squeeze head 73 to shift the carriage 84 from left-to-right. As a result, the upper squeeze head is moved laterally to the right into the molding station 65, the magazine 71 is moved laterally from the molding station to the filling station 66, and the gate 75 moves from beneath the chute 76 to allow sand to discharge into the magazine. Retraction of the rod of the actuator causes the components to move in the reverse position so as to re-close the chute 76, to return the magazine 71 to the molding station 65 and to shift the squeeze head 73 out of the filling station.

Figures 15, 16:
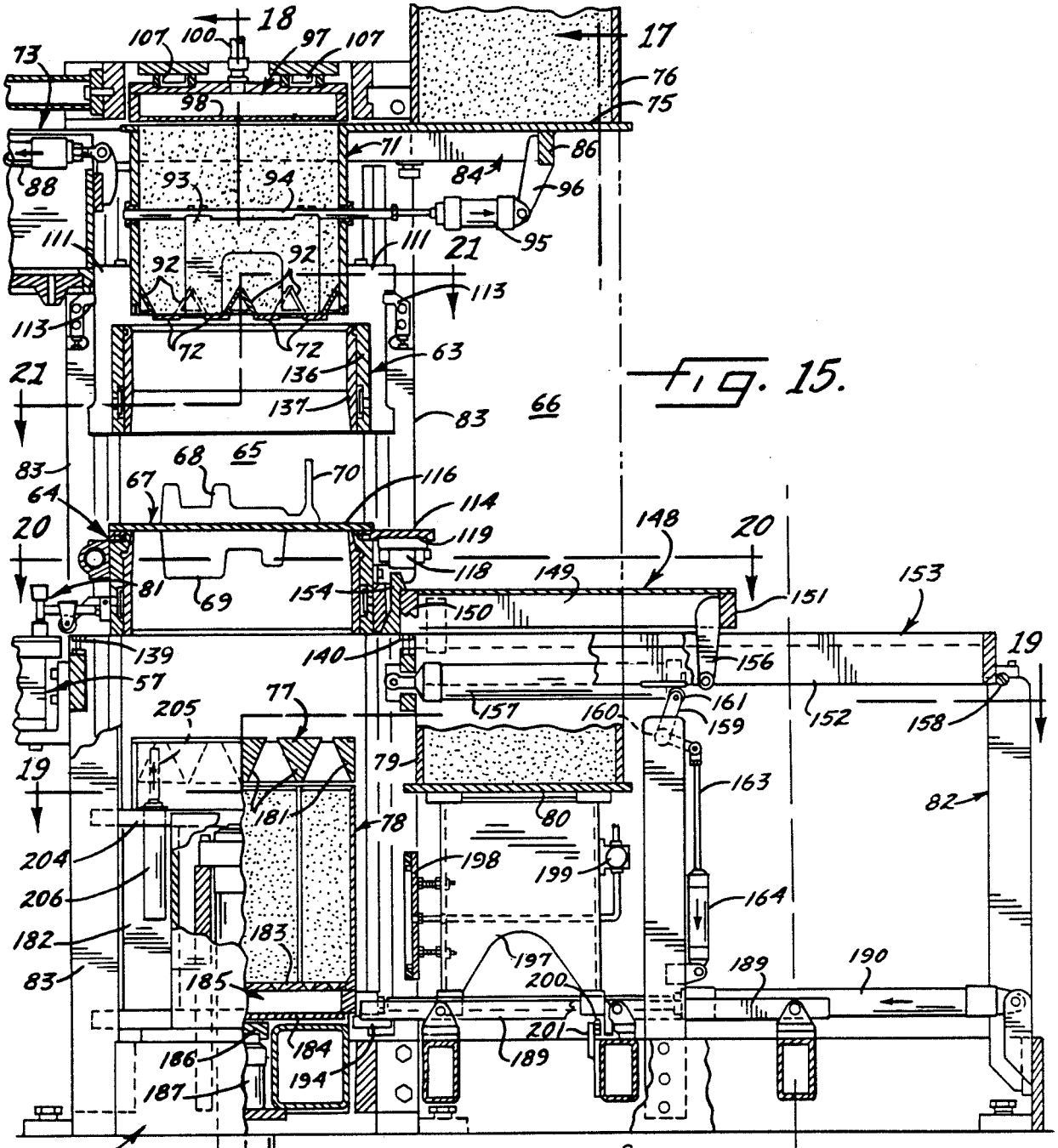
FIG. 15 is an enlarged fragmentary cross-section taken substantially along the line 15—15 of FIG. 1.
FIG. 16 is a perspective view of the matchplate and patterns.
Figure 21:
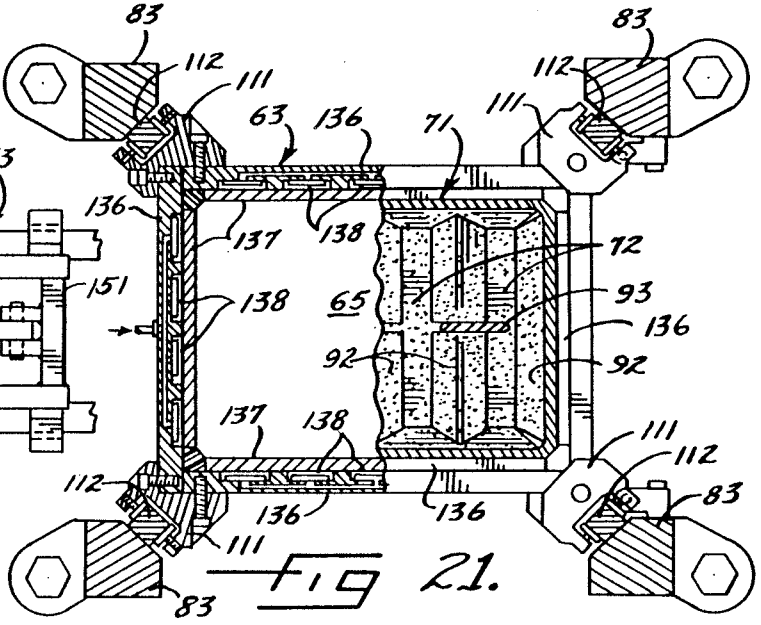
Figure 29:
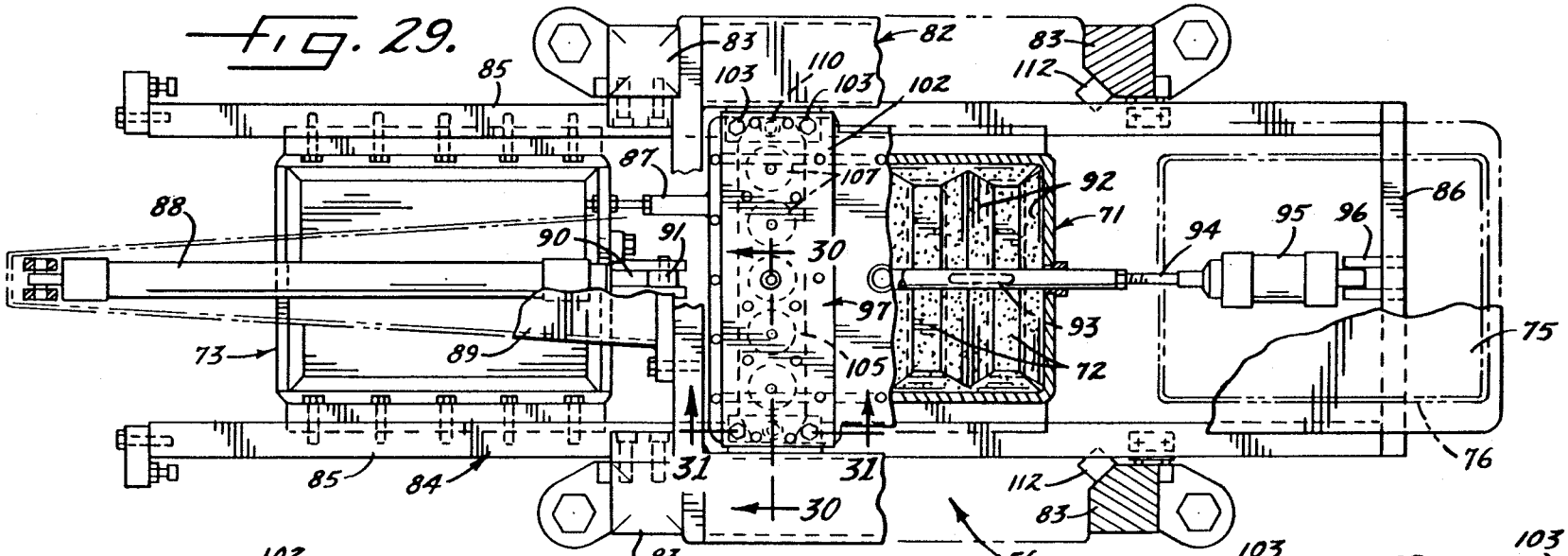
FIG. 29 is an enlarged fragmentary cross-section taken substantially along the line 29—29 of FIG. 2.

As shown most clearly in FIGS. 15, 21 and 29, the bottom of the upper sand magazine 71 is defined by generally V-shaped ribs 92 which are spaced laterally from one another so as to leave discharge slots between the ribs. The discharge slots normally are closed by the four gates 72 of the magazine 71, such gates being simply in the form of flat bars. Connected to all four of the gates 72 is a vertical actuator plate 93 (FIG. 15) which is located in the magazine 71 and whose upper end is secured to the rod 94 of a reciprocating actuator 95 supported by a bracket 96 on the cross rail 86 of the carriage 84. When the rod 90 is retracted, the gates 72 are held closed so as to retain sand in the magazine 71. Extension of the rod shifts the gates 72 to positions opening the discharge slots and permitting sand to be delivered therethrough and into the cope flask 63 by virtue of gravity and by virtue of the pressurized air injected into the sand magazine.

Figure 30:
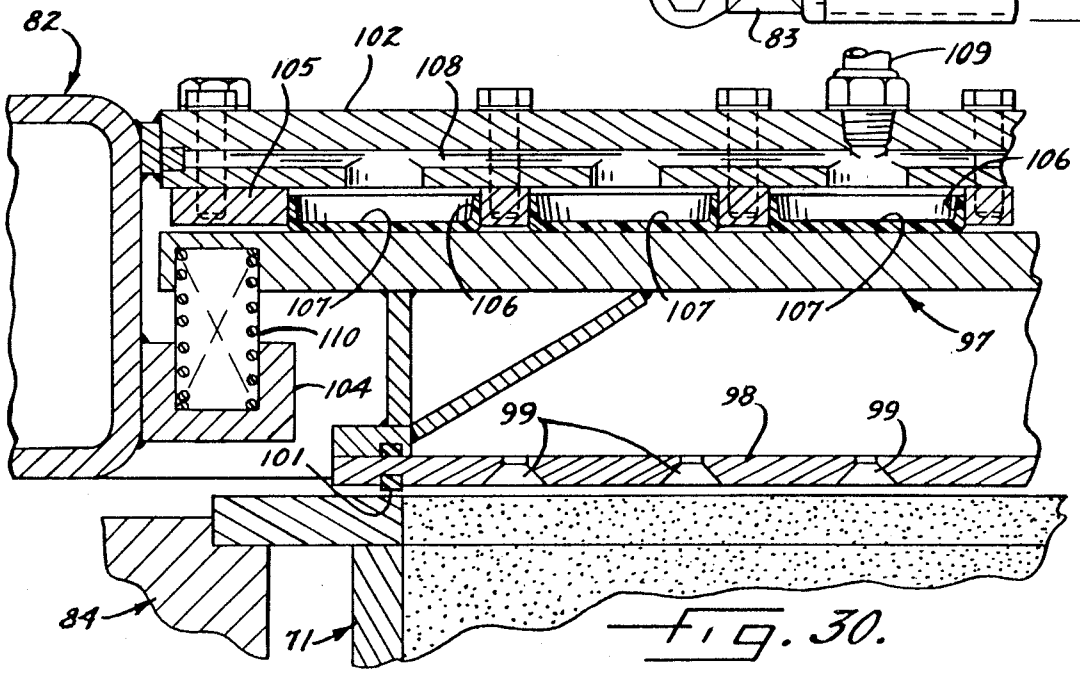

To enable the pressurized air to blow the sand effectively and substantially uniformly from the magazine 71, an air plenum 97 (FIGS. 18 and 30) overlies the magazine and includes a lower plate 98 (FIG. 30) which is formed with a series of vertically opening discharge ports 99. Pressurized air is admitted into a plenum through a line 100 (FIG. 15) at the top of the plenum.

Figure 31:
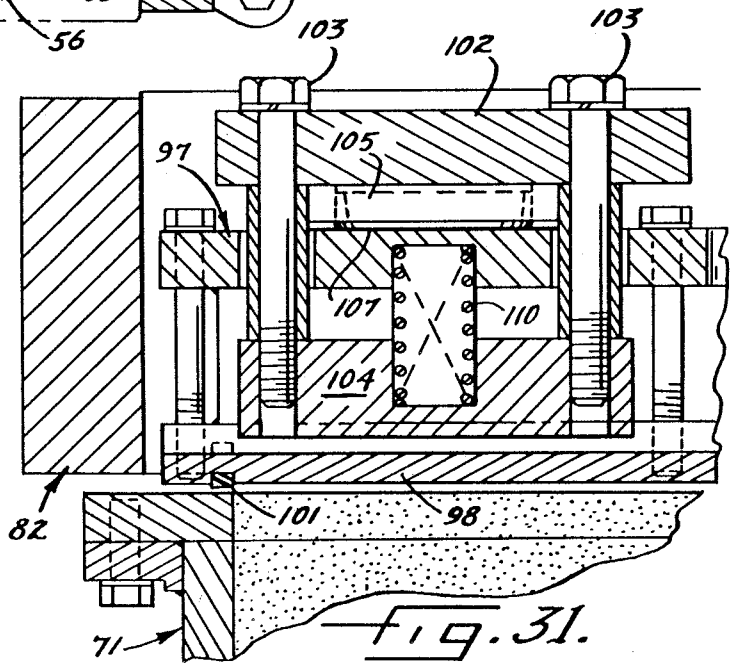
FIGS. 30 and 31 are enlarged fragmentary crosssections taken substantially along the lines 30—30 and 31—31, respectively, of FIG. 29.

Just before pressurized air is admitted into the plenum 97, the latter is moved downwardly to cause a sealing ring 101 (FIG. 30) on the lower side of the discharge plate 98 to engage and seal against the upper side of the sand magazine 71. For this purpose, a manifold plate 102 overlies the plenum 97 and is secured rigidly to the main support 82. Screws 103 (FIG. 31) extend through the end portions of the manifold plate, extend slidably through the top side of the plenum 97 and are threaded into bars 104 which are rigid with the main support 82. Thus, the bolts mount the plenum 97 for up and down movement.

An additional plate 105 (FIG. 30) defining a fixed support is secured to the underside of the manifold plate 102 and is formed with several spaced pockets 106. Telescoped into each pocket is a piston 107 in the form of a flexible cup. When the pockets 106 are pressurized by compressed air admitted into passages 108 of the manifold plate 102 through a line 109, the cups 107 flex downwardly to move the plenum 97 downwardly to an active position and thereby force the seal 101 of the discharge plate 98 against the magazine 71. This establishes a seal between the discharge plate 98 and the magazine 71 so that all of the pressurized air which is admitted into the plenum 97 through the line 100 is directed into the magazine to expel the sand therefrom in the prefill step shown in FIG. 6. After the cope flask 63 has been filled with sand, the pressure in the pockets 106 is relieved to enable springs 110 between the bars 104 and the plenum 97 to shift the plenum upwardly to a retracted position and thereby pull the plate 98 and the seal 101 out of engagement with the magazine 71. This leaves the magazine 71 free to shift laterally relative to the discharge plate 98 and to shuttle back and forth between the molding and filling stations 65 and 66.

The cope flask 63 is rectangular in shape and its corners carry guides 111 (FIG. 21) which ride along vertical rails 112 on the columns 83 in order to support the cope flask for up and down movement in the filling station 65. Fixed rigidly to the columns are stops 113 (FIG. 15) which underlie the guides 111 and which engage the guides to establish the lowermost position of the cope flask 63. The guides 111 are lifted a substantial distance upwardly off of the stops 113 when the cope flask is raised into telescoping relation with the sand magazine 71 (see FIGS. 5 and 6) and when the cope flask subsequently is raised into telescoping relation with the squeeze head 73 (see FIG. 9). When the drag mold 52 is first closed against the cope mold 51 as shown in FIG. 13, the guides 111 of the cope flask 63 are raised just a short distance off of the stops 113 in order to enable the weight of the cope mold 51 and the cope flask 63 to bear directly against the drag mold 52 and thereby establish good closure of the molds at the parting line 53.

Advantageously, the matchplate 67 comprises a window-like frame 114 (FIG. 16) with a rectangular opening 115 therethrough and further comprises a separate plate 116 which carries the pattern 68 and 69 and which is fastened removably by screws 117 (FIG. 26) to the frame 114 with the drag pattern 69 extending downwardly through the opening. With this arrangement, existing pattern plates 116 may be secured to frames 114 and adapted for use with the present mold making apparatus 56.

Figure 20:
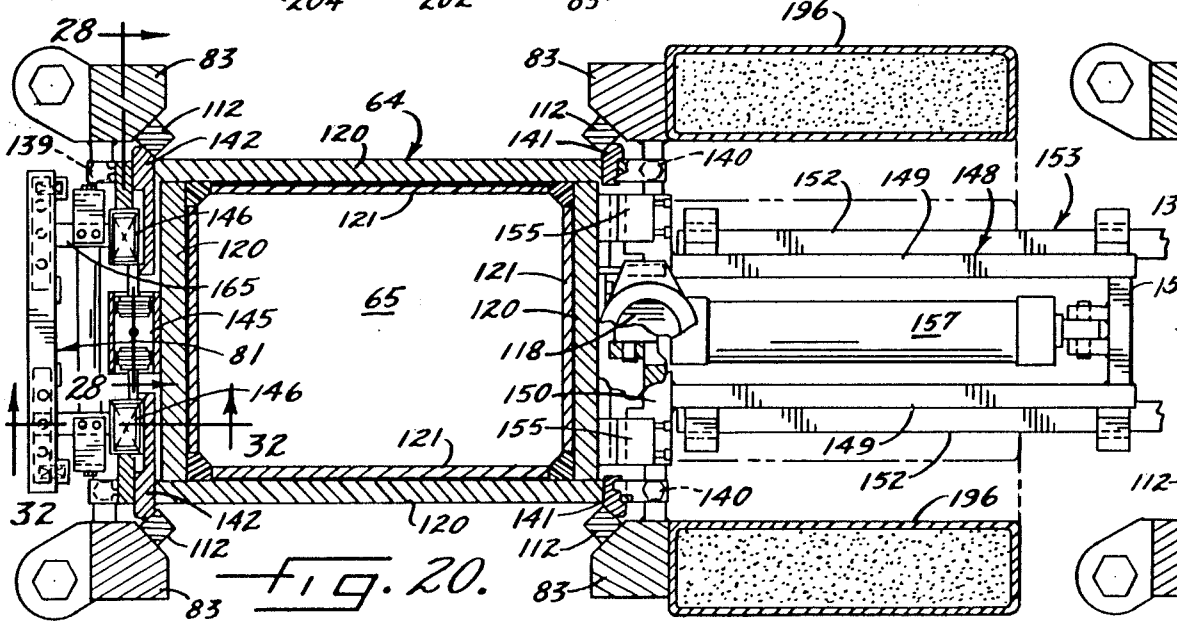

In another aspect, the invention contemplates the provision of means which directly engage and act directly upon the matchplate 67 to vibrate the latter. Herein, these means comprise a commercially available and power-driven vibrating unit 118 (FIGS. 17 and 20) supported on a flexible urethane mount on the right end of the drag flask 64 and underlying one end portion of the frame 114 of the matchplate 67. Formed in the lower side of the frame 114 is a shallow cylindrical pocket 119 (FIG. 16) which telescopically receives a correspondingly shaped portion of the vibrator unit 118. When the latter is energized, it directly shakes the matchplate to cause the matchplate to vibrate without need of shaking the entire drag flask 64 in order to impart vibration to the matchplate. The vibrating unit is energized from the time the flasks 63 and 64 are filled with sand (see FIG. 6) until just shortly after the time the patterns 68 and 69 are drawn from the molds 51 and 52 (see FIG. 10). The vibration imparted to the matchplate 67 first serves to promote good filling of the sand around the patterns and then tends to keep the patterns free in the sand so as to enable the patterns to be drawn out of the molds. To hold the vibrating unit in the pocket, a vacuum is drawn in the pocket by way of a port 119*a* and pulls upwardly on the vibrating unit. The vacuum also pulls the matchplate downwardly against the drag flask.

Figure 25:
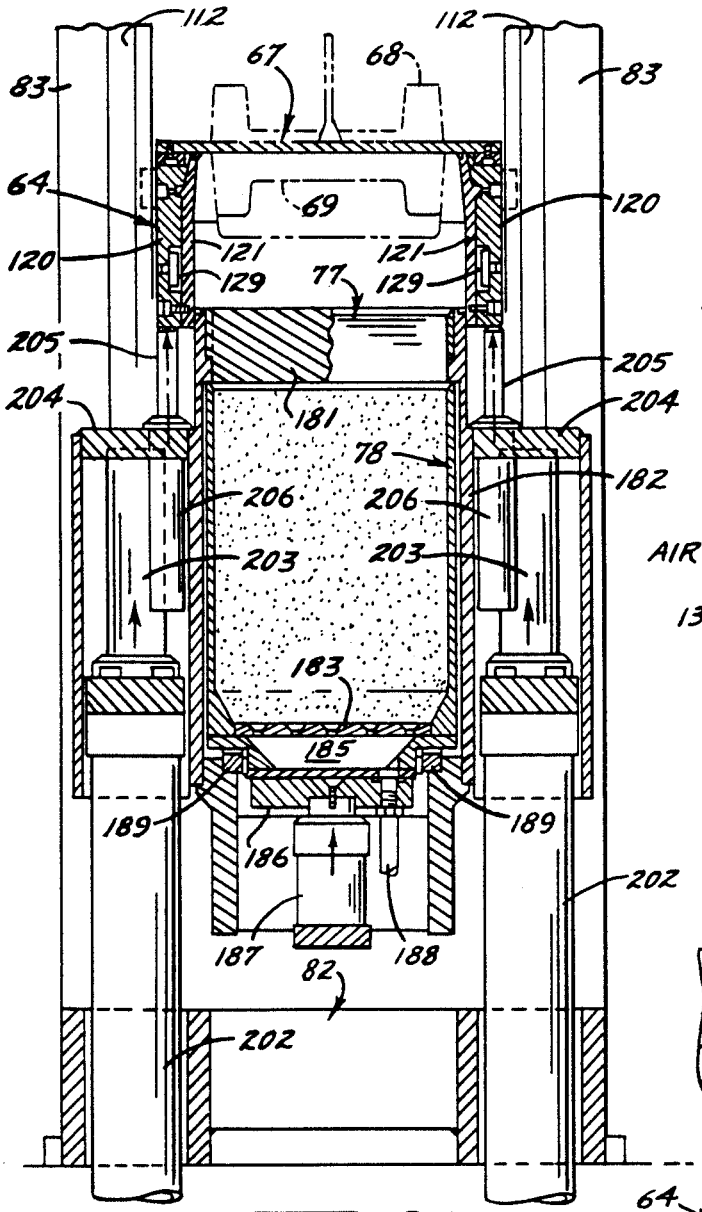
FIG. 25 is a view of certain parts illustrated in FIG. 18 with some parts shown in moved positions.
Figure 26:
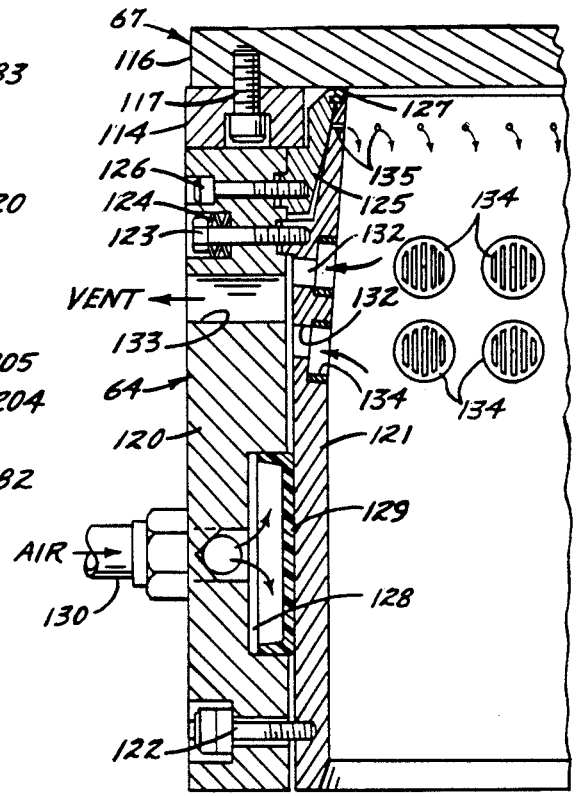
FIG. 26 is an enlarged fragmentary cross-section of the drag flask shown in FIG. 25.
Figure 27:
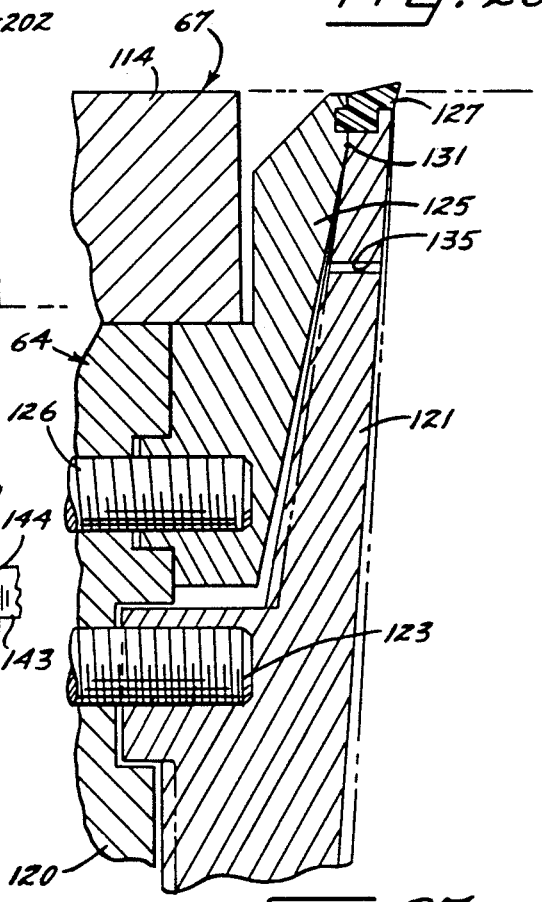
FIG. 27 is a greatly enlarged view of certain ones of the parts of the drag flask shown in FIG. 26.

Both flasks 63 and 64 are uniquely provided with a liner which holds the sand as the mold 51 or 52 is formed and which then expands to release the mold from the flask. Referring to FIGS. 25 to 27, it will be seen that the drag flask 64 includes main outside side walls 120 and opposing inside panels 121, the latter defining the liner. The lower end portions of the liner panels 121 are vertical while the upper end portions of the liner panels are inclined inwardly. By virtue of the shape of the panels, each drag mold 52 is formed with the upwardly tapered upper end portion 61 and with the vertical lower end portion 62.

The lower end portion of each liner panel 121 is secured to the lower end portion of the opposing flask wall 120 by screws 122 (FIG. 26) which extend slidably through the wall and which may be adjusted to establish a predetermined maximum spaced relation between the panel and the wall. Near its upper end, each panel 121 is secured to the opposing wall 120 by screws 123 which extend slidably through the wall and which are urged outwardly by Belleville springs 124. Located immediately above the screws 123 are collar pieces 125 located between the upper end portions of the walls 120 and the upper end portions of the panels 121 and secured to the walls by screws 126. A resilient gasket 127 is located between the upper ends of the panels 121 and the upper ends of the collar pieces 125 and is adapted to seal against the plate 116 of the matchplate assembly 67.

Formed in the inner sides of the drag flask walls 120 are several cylindrical pockets 128 (FIG. 26) which receive pistons in the form of flexible cups 129. When the pockets are pressurized by compressed air supplied to the pockets via a line 130, the pistons 128 push inwardly against the liner panels 121 and cause each panel to pivot inwardly about a horizontal pivot axis 131 (FIG. 27) located just below the gasket 127 and extending lengthwise of the liner panel. The pistons 128 thus collapse the panels 121 toward one another and the panels are held in their collapsed positions from the time sand is first delivered into the drag flask 64 (FIG. 6) until just prior to the time the drag mold 52 is lowered out of and drawn from the drag flask (FIG. 10). Just prior to drawing of the drag mold, the pressure in the pockets 128 is relieved so as to enable the Belleville springs 124 to expand the liner panels 21 outwardly away from the mold 52 and toward the flask walls 120. Such expansion creates about 1/16" clearance between the panels and the mold and allows the mold to be released from the drag flask without need of moving the flask walls apart. The inwardly collapsed position on a liner panel 121 is shown in phantom lines in FIG. 27 while the expanded position of the liner panel is shown in full lines.

When the sand in the drag flask 64 is compacted by the lower squeeze head 77 (FIG. 9), air in the sand is permitted to escape therefrom by way of vent openings 132 (FIG. 26) formed in the panels and communicating with vent holes 133 in the flask walls 120, the vent openings being covered by grate-like discs 134. Additional air passages 135 (FIGS. 26 and 27) are formed in the liner panels 121 above the vents 132. When the drag mold 52 is drawn from the flask 64, pressurized air is directed through the passages 135 in order to pressurize the space between the upper side of the mold and the lower side of the plate 116 and thereby prevent a vacuum from forming in such space and restricting removal of the mold.

The interior construction of the cope flask 63 is very similar to that of the drag flask 64 and thus the cope flask includes outside walls 136 (FI. 21), inside liner panels 137, pistons 138 for contracting the panels inwardly and Belleville springs (not visible) for expanding the panels outwardly for purposes of releasing the cope mold 51. The liner panels 137 of the cope flask are contracted from the time sand is first delivered into the flask (FIG. 6) until just prior to the time the mold 52 is drawn from the flask (FIG. 14). As a result of the liner panels, the cope mold 51 is held tightly in the cope flask 63 during the mold forming steps shown in FIGS. 9 to 13 and then is released from the flask when the air behind the pistons 138 is relieved just prior to the lowering step illustrated in FIG. 14. The liner panels 137 of the cope flask 63 are shaped so as to cause the cope mold 51 to taper upwardly.

Like the cope flask 63, the drag flask 64 is supported to move upwardly and downwardly on the rails 112 on the columns 83 and is adapted to be held at certain times by fixed lower stops 139 and 140 (FIG. 15) located adjacent the columns. Unlike the cope flask, however, the drag flask must be periodically unlocked from the rails, shifted laterally from the molding station 65 to the standby position, returned to the molding station and then re-locked to the rails. In order to guide the drag flask 64 for up and down movement on the rails 112, one pair of guide bars 141 (FIG. 20) is mounted on the right end of the drag flask near the upper corners thereof while another pair of guide bars 142 is mounted adjacent the upper corners of the left end of the drag flask. The guide bars 141 are fixed laterally and simply ride upwardly and downwardly along the right sides of the adjacent rails 112. The guide bars 142, however, are locking bars and are adapted to be shifted between active positions in which they engage the left sides of the adjacent rails 112, and released positions in which the guide bars clear the rails 112 to enable the drag flask 64 to be shifted laterally out of and into the molding station 65.

Figure 28:
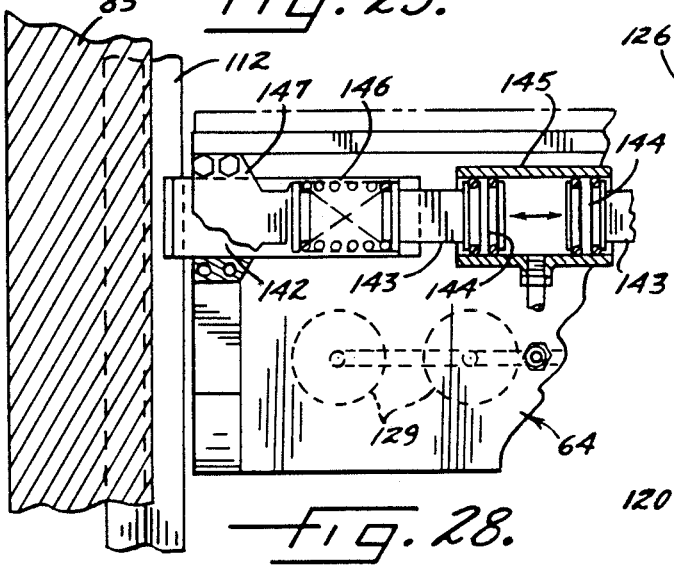
FIG. 28 is an enlarged fragmentary cross-section taken substantially along the line 28—28 of FIG. 20.

To achieve the foregoing, the locking bars 142 are connected rigidly to rods 143 (FIG. 28) which, in turn, are connected to pistons 144 slidable in a cylinder 145 on the left end of the drag flask 64. When the cylinder 145 is pressurized, the locking bars 142 are extended and lock against the left side of the adjacent rails 112 to captivate the drag flask 64 laterally on the rails while permitting the flask to move upwardly and downwardly on the rails. As the locking bars 142 extend, the rods 143 compress coil springs 146 located between the rods and fixed stops 147 on the left end of the drag flask. Accordingly, when the pressure in the cylinder 145 is relieved, the bars are retracted away from the rails and to positions permitting the drag flask 64 to be shifted laterally to the right out of the molding station 65 and subsequently returned to the left and back to the molding station.

In order to enable lateral shifting of the drag flask 64 from the molding station 65 to the standby position, provision is made of a carriage 148 (FIGS. 15 and 22) which not only shifts the drag flask but also raises the drag flask upwardly off of the stops 139 and 140 prior to effecting the shifting. Herein, the carriage 148 is defined by a pair of laterally extending bars 149 whose ends are connected by cross bars 150 and 151. The bars 149 are guided for lateral sliding on a pair of underlying rails 152 which form part of a base 153 located below the carriage 148.

Two spaced claws 154 (FIG. 22) are fastened rigidly to and project upwardly from the cross bar 150 of the carriage 148. The claws are adapted to interlock releasably with a pair of downwardly opening hooks 155 fastened rigidly to the right end of the drag flask 64. In addition, the lower end portions of the claws engage the lower end portion of the right end of the drag flask. Thus, the claws 154 are capable of pulling the drag flask laterally out of and pushing the flask back into the molding station 65 and also permit the flask to be raised to the positions shown in FIGS. 5 to 9. The hooks 155 simply lift off of the claws 154 when the flask is raised and then re-engage the claws when the flask is lowered. In its lowered position, the flask 64 is supported directly by the stops 139 on the two left columns 83 and is supported indirectly by the stops 140 on the two right hand columns, the latter two stops engaging the lower side of the cross bar 150 of the carriage 148 (see FIG. 15).

Connected between the main support 82 and a bracket 156 on the cross bar 151 of the carriage 148 is a reciprocating hydraulic actuator 157 having a rod 157A which is adapted to shift the carriage back and forth on the base 153 so as to move the drag flask 64 into and out of the molding station 65. Before the drag flask is shifted out of the molding station, however, the carriage 148 is moved upwardly a slight distance so as to lift the flask 64 and the cross bar 150 of the carriage off of the stops 139 and 140 and thereby permit free lateral movement of the flask. For this purpose, the right end of the base 153 is connected to the main support 82 by a horizontal pivot 158 (FIG. 22) which permits the left end portions of the base and the carriage to swing upwardly and downwardly. A bellcrank 159 is pivotally connected at 160 to the main support 82 and includes a vertically extending arm whose upper end carries a roller 161 adapted to engage, a pad 162 on the underside of one of the rails 152 of the base 153. The other arm of the bellcrank is connected to the rod 163 of a vertical hydraulic actuator 164 connected to the main support 82.

Figure 22:
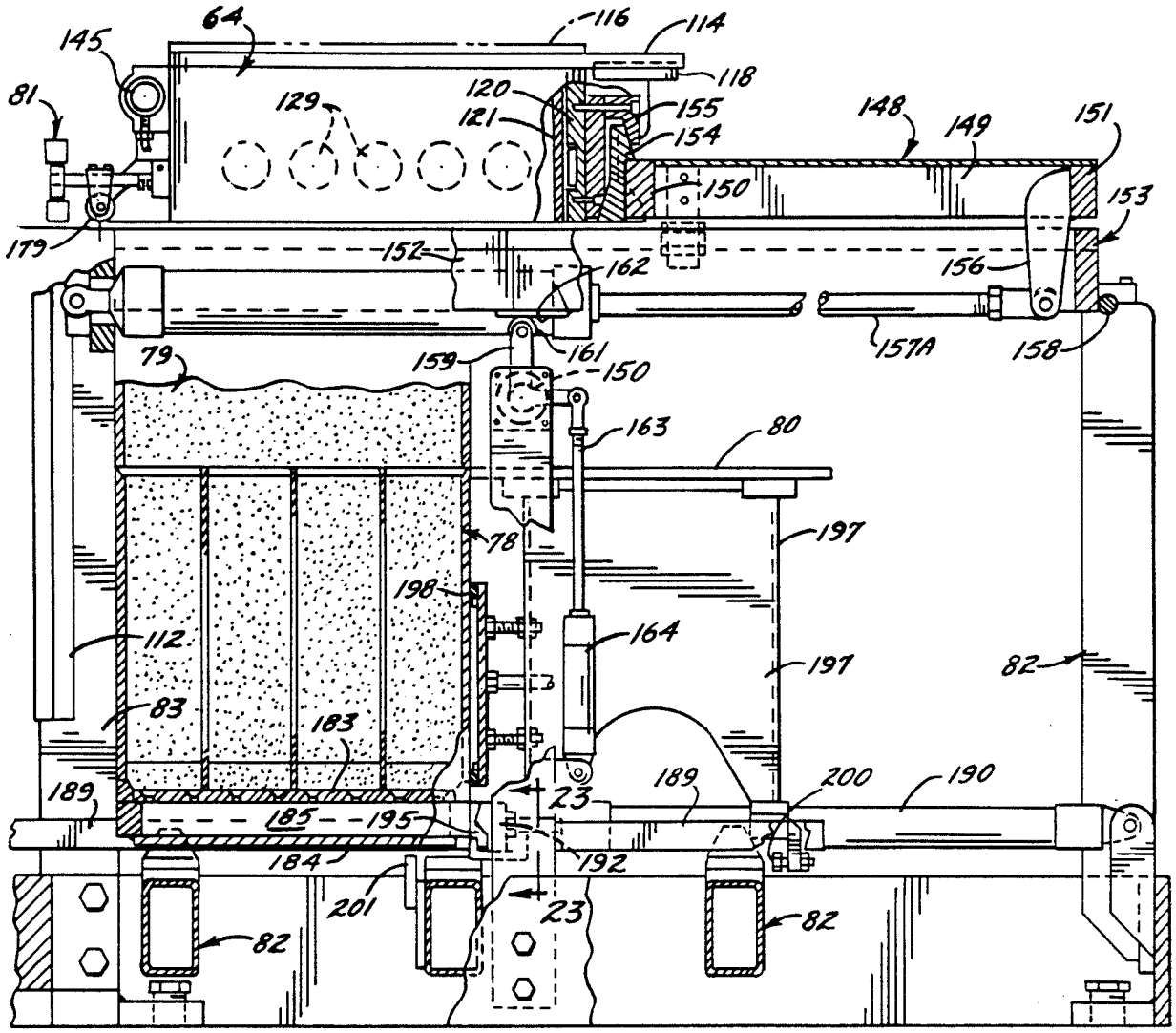
FIG. 22 is an enlarged view of certain parts illustrated in FIG. 15 with some parts being shown in moved positions.

When the rod 163 of the actuator 164 is extended to the position shown in FIG. 22, the bellcrank 159 is rocked counterclockwise about the pivot 150 so as to cause the roller 161 to bear upwardly against the pad 162 and thereby swing the base 153 and the carriage 148 in a clockwise direction and through a short distance about the pivot 158. As a result of such swinging, the drag flask 64 and the cross bar 150 of the carriage 148 are lifted upwardly off of the stops 139 and 140 of the columns 83. The rod 157A of the actuator 157 then may be extended to shift the carriage 148 laterally to the right and cause the claws 154 to pull the flask 64 out of the molding station 65 without any interference with the stops 139 and 140. The actuator 164 acts through the bellcrank 159 to hold the carriage in its upwardly pivoted position until after the flask 64 has been returned from the standby position of FIG. 14 to the molding station as shown in FIG. 3. The rod 163 of the actuator 164 then is retracted to allow the weight of the flask 64 and the carriage 148 to return these components downwardly against the stops 139 and 140.

When the drag flask 64 is returned to the left from the position of FIG. 14 to the position of FIG. 3, the pusher 81 on the left end of the drag flask shoves the newly formed mold 50 off of the lower squeeze head 77 and onto the conveyor 57. The pusher is characterized in that it is capable of intimately engaging the drag mold 52 and maintaining good control thereover even though the vertical portions 62 of different molds are of different heights and cause the tapered portions 61 of different molds to be disposed at different lateral positions.

The pusher is shown most clearly in FIG. 20 and FIGS. 32 to 35 and comprises a pair of spaced driver bars 165 (FIG. 20) extending from the left end of the drag flask 64. Each driver bar is supported to pivot upwardly and downwardly relative to the flask by a horizontal pivot 166 (FIGS. 32 and 34) and its horizontal position is controlled by an adjustable stop 167.

The free end portions of the two driver bars 165 support an upper pusher bar 168 (FIGS. 32 to 35) for engaging the tapered portion 61 of the drag mold 52 and a lower pusher bar 169 for engaging the vertical portion 62 of the mold. For this purpose, each driver bar 165 carries a vertical pin 170 which is connected between the ends of a pair of links 171 and 172 located on the upper and lower sides, respectively, of the driver bar. The links are connected rigidly to the pin 170, and the latter is supported to turn relative to the respective driver bar 165. The upper link 171 of each pair is pivotally connected at 173 to the upper pusher bar 168 while the lower link 172 is connected pivotally at 174 to the lower pusher bar 169. A coil spring 175 (FIG. 34) is compressed between the outboard end portion of each lower link 172 and the adjacent end portion of the lower pusher bar 169 and urges the links 171 and 172 to pivot in one direction about the axis of the pin 170. Such pivoting of each pair of links 171 and 172 about the pin 170 is limited by virture of the inboard end of the upper link 171 engaging a fixed stop 176 depending from the upper pusher bar 168.

Figure 32:
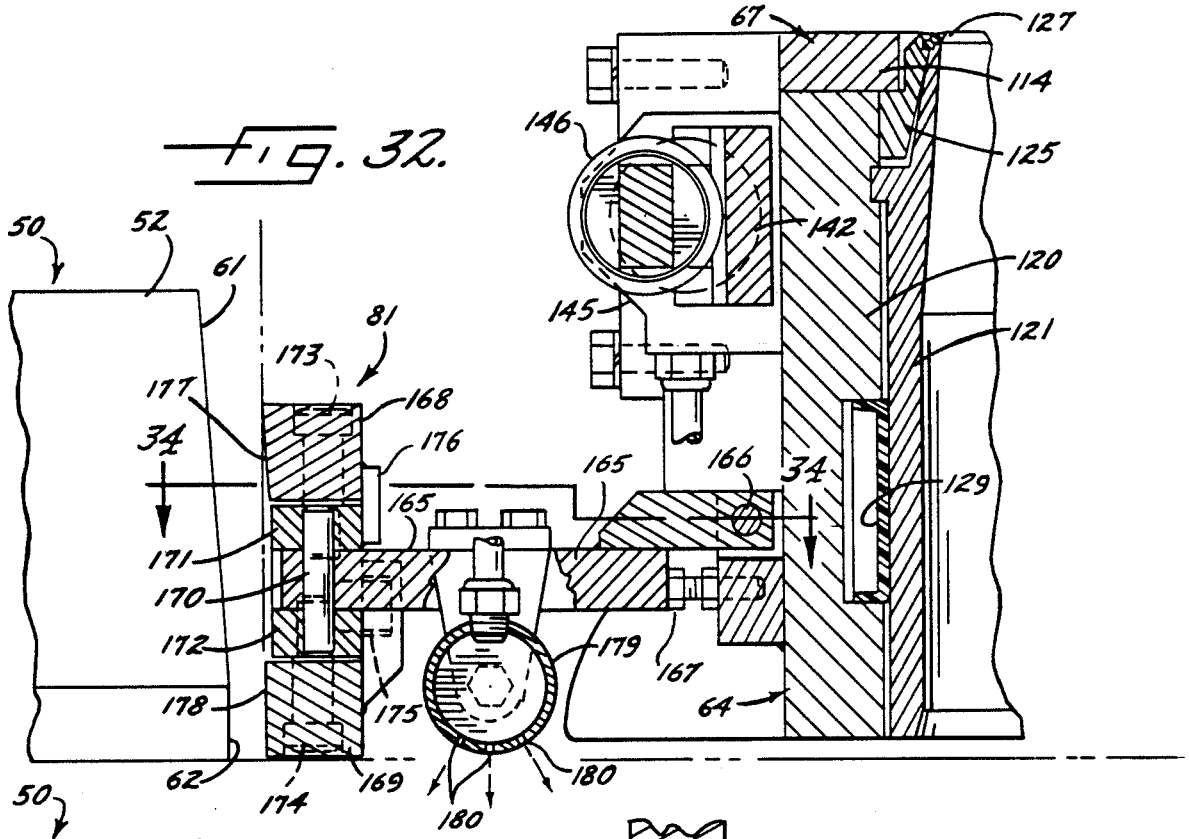
FIG. 32 is an enlarged fragmentary cross-section taken substantially along the line 32—32 of FIG. 20.
Figure 33:
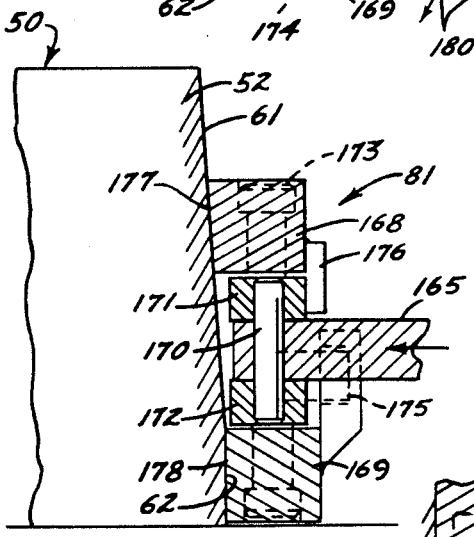
FIG. 33 is a view of certain parts illustrated in FIG. 32 and shows those parts moved to active positions.
Figure 34:
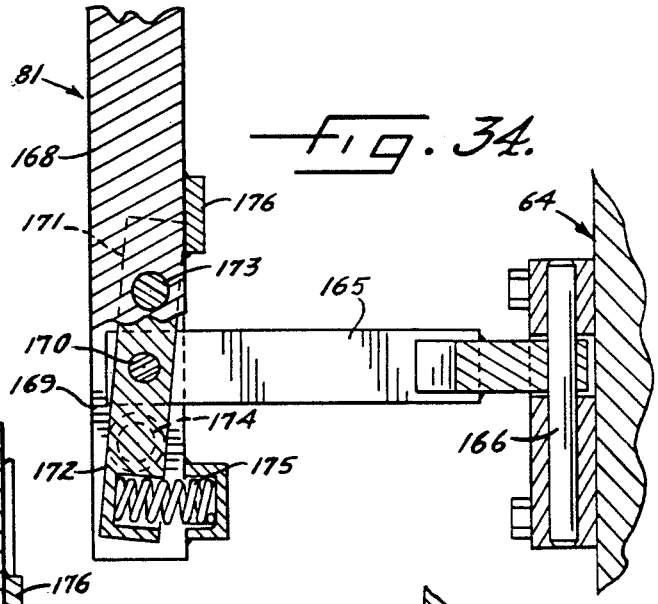
FIG. 34 is a fragmentary cross-section taken substantially along the line 34—34 of FIG. 32.
Figure 35:
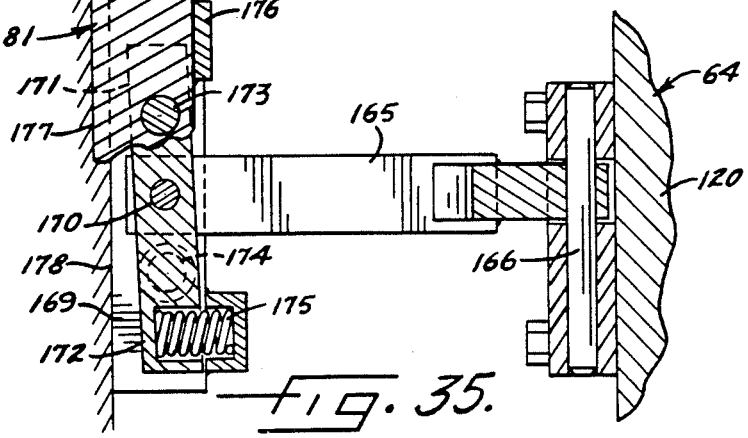
FIG. 35 is a view similar to FIG. 34 but shows certain parts moved to active positions.

With the foregoing arrangement, the spring 175 associated with the lower link 172 of each pair normally urges the upper link 171 of the pair against the stop 176 so as to cause the active faces 177 and 178 of the pusher bars 168 and 169, respectively, to be substantially in vertical alinement with one another as shown in FIGS. 32 and 34. The active face 177 of the upper pusher bar 168 is inclined generally in accordance with the upper tapered portion 61 of the drag mold 52 while the active face 178 of the lower pusher bar 167 is vertical so as to engage the lower vertical portion 62 of the mold.

When the drag flask 64 is moved from right-to-left, the lower pusher bar 169 engages the lower vertical portion 62 of the drag mold 52 and is stopped. As a result—and with continued movement of the drag flask—the lower pusher bar acts through the pins 174 to effect pivoting of the lower links 172 against the bias of the springs 175. The lower links 172 turn the pins 170 which act through the upper links 171 and the pins 173 to shift the upper pusher bar 168 from right-to-left relative to the lower pusher bar 169 (compare FIGS. 32 and 34 with FIGS. 33 and 35). Such shifting of the upper pusher bar 168 continues until its active face 172 engages and stops against the upper tapered portion 61 of the mold, at which time the two bars 168 and 169 move in unison to push the mold 52 laterally off of the lower squeeze head 77 and onto the transfer conveyor 57. When the transfer conveyor moves the mold 50 away from the flask 64, the springs 175 return the upper pusher bar 168 to the right to its original alined position with the lower pusher bar 169 (see FIGS. 32 and 34).

Thus, the lower pusher bar 169 engages the drag mold 52 first and causes the upper pusher bar 168 to move toward the mold until the upper pusher bar engages the tapered portion 61 of the drag mold. In this way, the upper pusher bar is always brought into close engagement with the tapered portion 61 even though the height of the vertical portion 62 may vary widely.

When the drag flask 64 shifts from the molding station 65 (FIG. 10) to the standby position (FIG. 11), loose sand is blown out of the cavity of the drag mold 52. To this end, a pipe 179 (FIG. 32) with discharge ports 180 spans the two driver bars 165. Pressurized air is introduced into the pipe and jets of air shoot through the ports to blow sand out of the lower cavity as the pipe traverses across the drag mold during shifting of the drag flask to the standby position.

Figure 18:
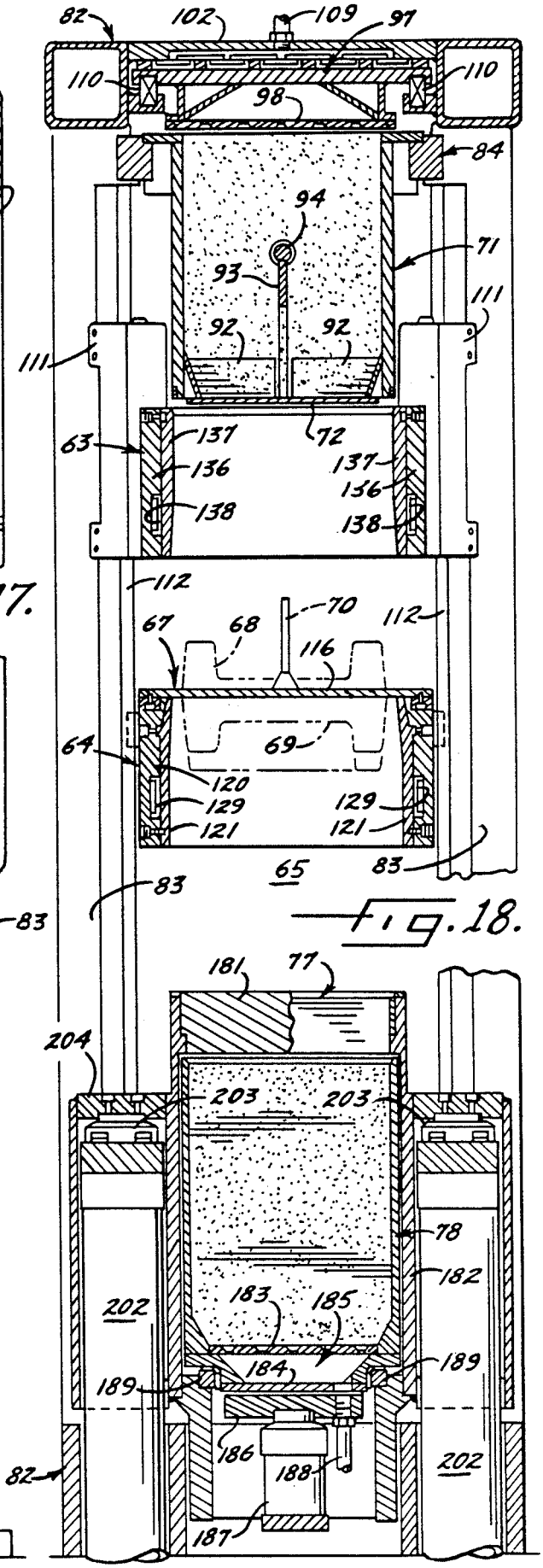

The lower squeeze head 77 is defined by a series of rigidly connected members 181 (FIGS. 15 and 18) which are spaced apart so as to define openings allowing sand from the lower sand magazine 78 to be blown upwardly through the squeeze head. The squeeze head also includes a lower housing 182 which supports the lower sand magazine 78. As shown in FIG. 18, the lower magazine includes an apertured plate 183 which, together with a lower vertically spaced plate 184, defines an air plenum 185. During the sand prefilling step of FIG. 6, a header bar 186 is held upwardly in sealed engagement with the plate 185 by a fluid operated actuator 187. To effect the prefilling, compressed air from a line 188 is introduced into the plenum 185 through ports in the header 186 and the plate 184 and flows upwardly through the apertured plate 183 to blow sand in the magazine 78 up through the squeeze head 77 and into the drag flask 64. The magazine remains pressurized until the drag flask is filled. Thereafter, the compressed air is cut off, and the actuator 187 pulls the header 186 downwardly away from the plate 184 so as to provide clearance enabling the sand magazine 78 to be shifted laterally out of the housing 182 and moved to the filling station 65. The sand compacts sufficiently in the drag flask so as to not fall back downwardly therefrom.

Figure 23:
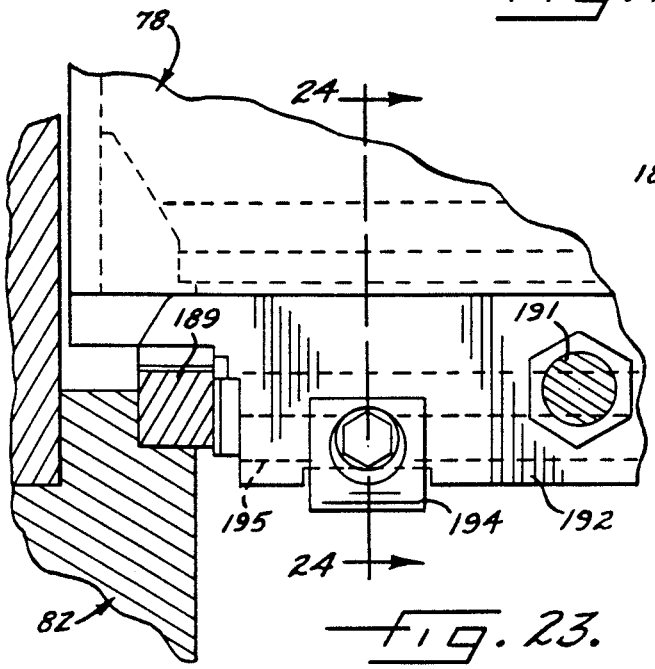
FIG. 23 is an enlarged fragmentary cross-section taken substantially along the line 23—23 of FIG. 22.
Figure 24:
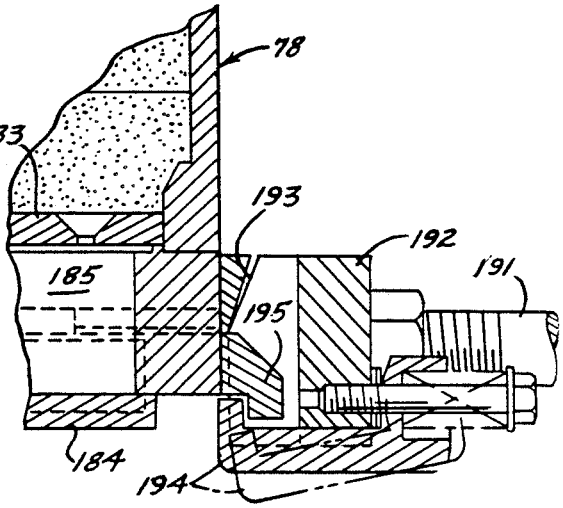
FIG. 24 is a fragmentary cross-section taken substantially along the line 24—24 of FIG. 23.

The sand magazine 78 is supported for lateral movement between the molding station 65 and the filling station 66 by a pair of laterally extending lower rails 189 (FIGS. 15 and 19) secured rigidly to the main support 82. A laterally extending hydraulic actuator 190 is connected to the support 82 and includes a rod 191 adapted to pull the magazine 78 out of the molding station 65 and to push the magazine back into the molding station. Connected to the free end of the rod 191 is a mounting bar 192 (FIGS. 22 to 24) having pushing surfaces 193 (FIG. 24) for shoving the magazine 78 from right-to-left and having spring-loaded and pivoted hooks 194 for pulling the magazine from left-to-right. During such pulling, the hooks engage a depending flange 195 on the magazine. The pushing surfaces 193 and the hooks 194 are positioned to permit the sand magazine 78 to move upwardly away from the rod 191 from the position shown in FIG. 10 to the position shown in FIG. 13 and then to re-connect with the rod upon subsequently being moved back downwardly to the position shown in FIG. 10.

Figure 17:
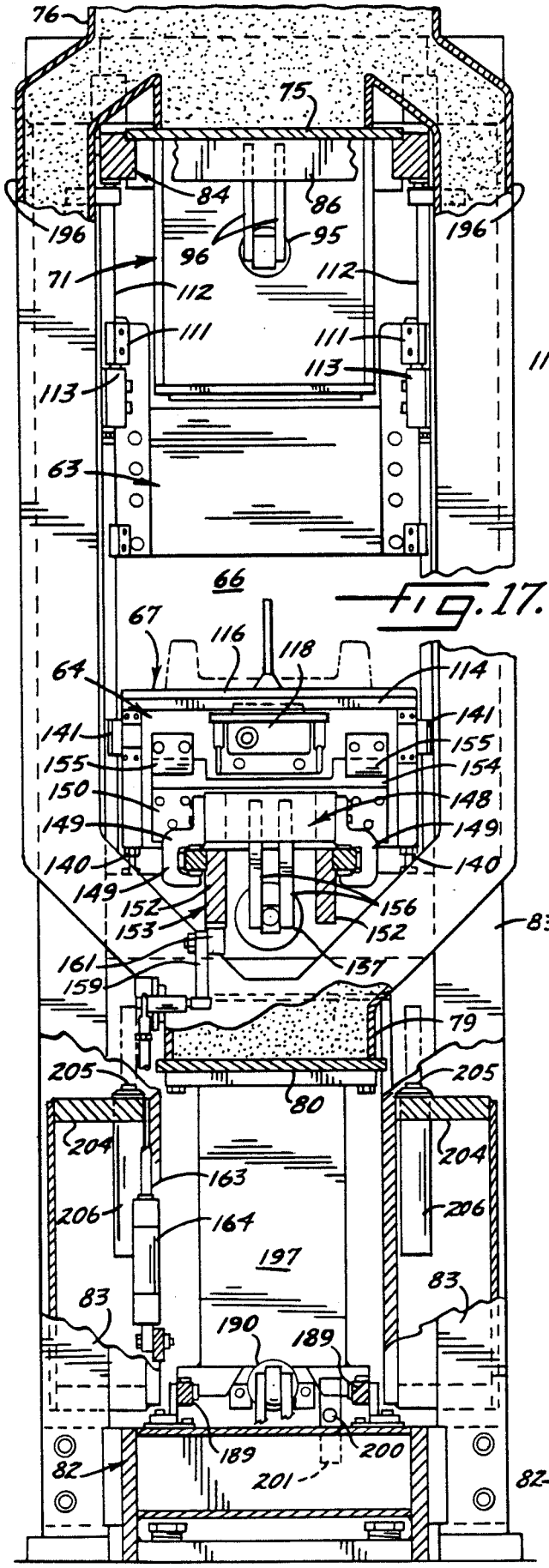
FIGS. 17, 18, 19, 20 and 21 are enlarged fragmentary cross-sections taken substantially along the lines 17—17, 18—18, 19—19, 20—20 and 21—21, respectively, of FIG. 15.

FIG. 17 shows two widely spaced and vertically extending sand supply ducts 196 which lead from the upper sand chute 76 to the lower sand chute 79 in order to deliver sand to the latter chute. The gate 80 for closing the lower sand chute is carried on the upper end of a supporting means in the form of a pedestal 197 (FIGS. 15 and 17) which also is guided for back and forth lateral movement on the rails 189. The pedestal is spaced laterally from the lower sand magazine 78 when the magazine is located in the molding station 65 as shown in FIG. 15.

Advantageously, coupling means in the form of a vacuum pad 198 (FIG. 15) is attached to the pedestal 197. When the sand magazine 78 is shifted from left-to-right from the molding station 65 to the filling station 66, the magazine engages the vacuum pad 198 and pushes the pedestal 197 to the right in order to open the gate 80 and permit sand to be discharged from the chute 79 and into the magazine (see FIG. 22). When the magazine is subsequently returned to the left, a vacuum under the control of selectively operable valve means 199 (FIG. 15) is drawn in the pad to cause the pad to grip the right side of the magazine. As a result, the magazine 78 pulls the pedestal 197 to the left to cause the gate 80 to re-close the chute 79. Leftward movement of the pedestal 197 is stopped when an adjustable stop 200 (FIGS. 15 and 22) on the pedestal engages a stop 201 on the main support 82. At that time, the valve 199 is actuated to release the vacuum in the pad 198 and enable the sand magazine 78 to continue to move to the left to the molding station 65. Thus, the vacuum pad 198 provides a simple means by which the sand gate 80 may be moved between open and closed positions by the sand magazine 78 without requiring a separate actuator for the gate and while leaving the magazine free to move vertically relative to the gate.

Figure 19:
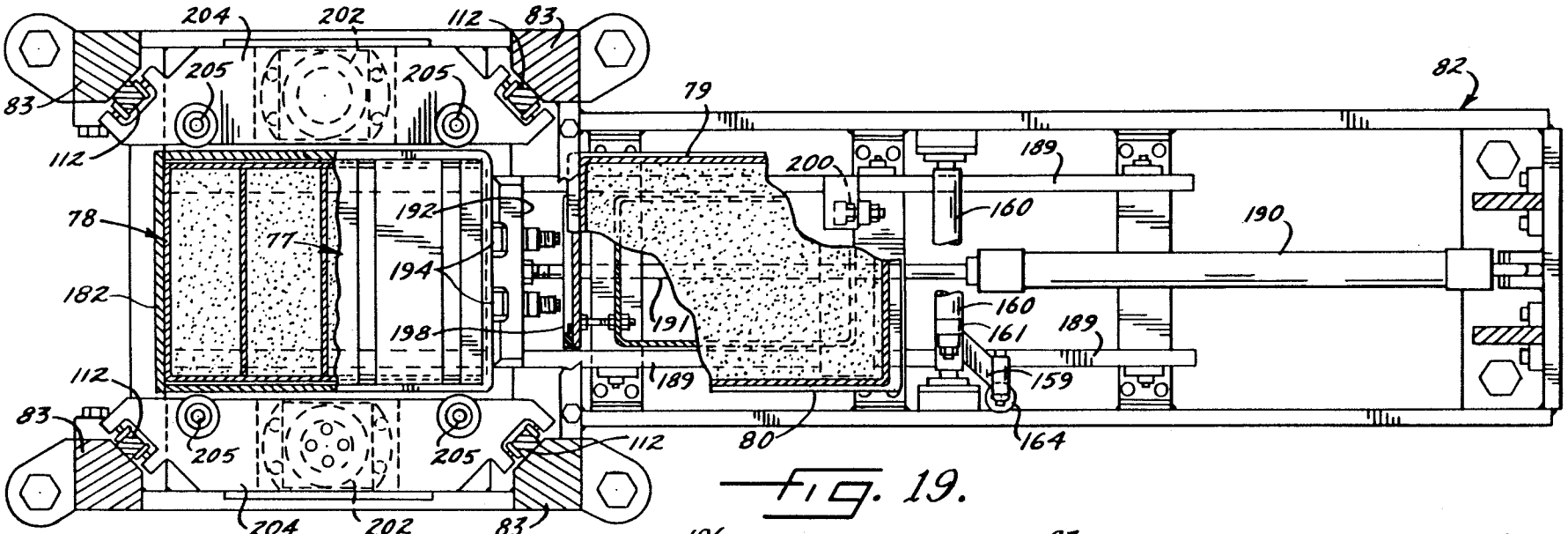

Vertical movement of the lower sand magazine 78, the lower squeeze head 77, and the drag flask 64 is effected by a pair of vertically extending hydraulic actuators 202 (FIG. 24) connected to the main support 82 and having rods 203 attached to massive flanges 204 (FIGS. 19 and 25). The flanges are secured to the housing 182 of the squeeze head 77 and engage the rails 112 to guide the squeeze head and the lower sand magazine for up and down movement along the columns 83.

When the rods 203 of the actuators 202 are fully retracted, the lower squeeze head 77 and the lower sand magazine 78 are held in their lowermost positions as shown in FIGS. 10 to 12. Initial extension of the rods 203 raises the lower magazine, the lower squeeze head and the drag mold 52 upwardly as shown in FIG. 13 to cause the drag mold to lift the cope flask 63 a short distance off of the stops 113 and thereby effect good closure between the cope and drag molds 51 and 52. Thereafter, the rods are partially retracted to lower the bottom of the completed mold 50 to the level of the transfer conveyor 57 as shown in FIG. 14 and also in FIG. 3.

Figure 8:
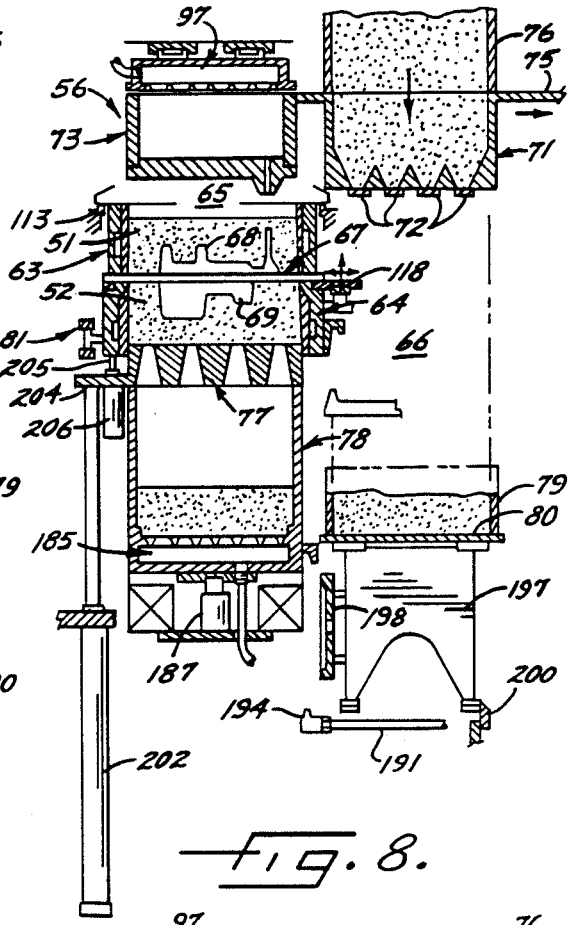
Figure 9:
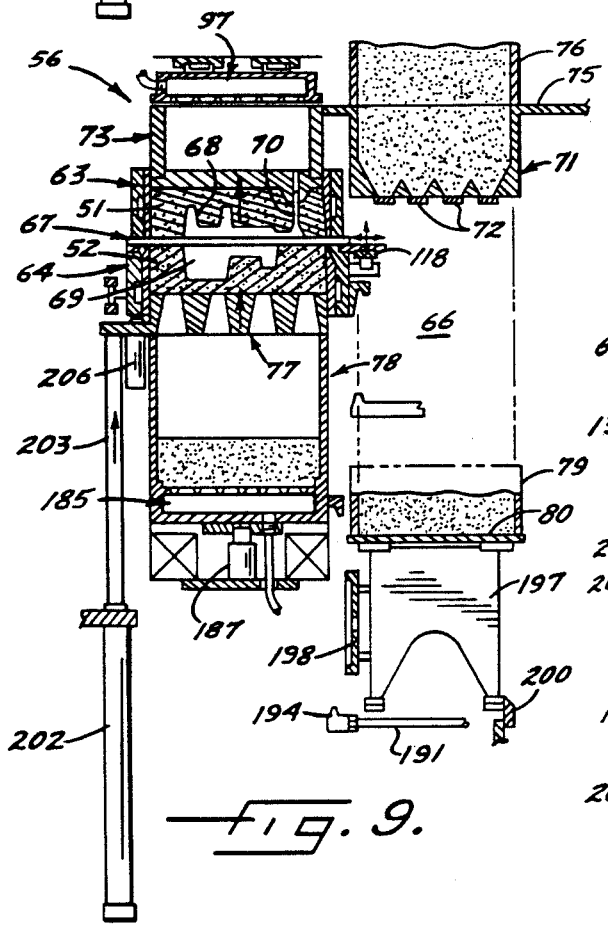

Following transfer of the completed mold 50 to the conveyor 57, the rods 203 of the actuators 202 are extended slightly to cause the lower squeeze head 77 to telescope into the drag flask 64 as shown in FIG. 4. Just prior thereto, the rods 205 (FIGS. 17, 19 and 25) of four small fluid-operated actuators 206 on the flanges 204 are extended upwardly a predetermined distance to engage the lower end of the drag flask 64 and limit the distance the squeeze head 77 is permitted to telescope upwardly into the cope flask 63. In this way, control is established over the volume of sand loaded into the drag flask. The actuators 206 are kept in a pressurized state during raising of the flasks 63 and 64 to the prefilling position of FIGS. 5 and 6, during downward shifting of the cope flask 63 to clear the upper sand magazine 71 as shown in FIG. 7 and while the upper squeeze head 73 is being shifted to the molding station 65 as shown in FIG. 8. When the rods 203 are extended to cause squeezing of the molds 51 and 52 between the heads 73 and 77, the pressure in the actuators 206 is gradually relieved to enable the lower squeeze head 77 to move further upwardly into the drag flask 64 as shown in FIG. 9 and effect full compaction of the sand. Thus, the actuators 206 limit the penetration of the squeeze head 77 into the drag flask 64 during prefilling but permit full penetration during squeezing. By adjusting the stroke of the actuators 206, the volume of sand loaded into the drag flask may be controlled. By adjusting the stroke of the actuators 202 during shifting from the position of FIG. 4 to that of FIG. 5, the volume of sand loaded into the cope flask 63 also may be controlled.

The transfer conveyor 57 (FIGS. 36 to 45) is of a unique construction for advancing the molds 50 between the mold making section 56 and the turntable 58 while allowing molds to accumulate on the conveyor without overrunning one another. The conveyor includes a main frame indicated generally by the reference numeral 207 and having an upstream end which is attached to the main support 82 of the mold making section 56 by mounting brackets 208. As shown in FIG. 2, the frame extends laterally from the molding station 65.

Figures 36, 37, 38, 39:
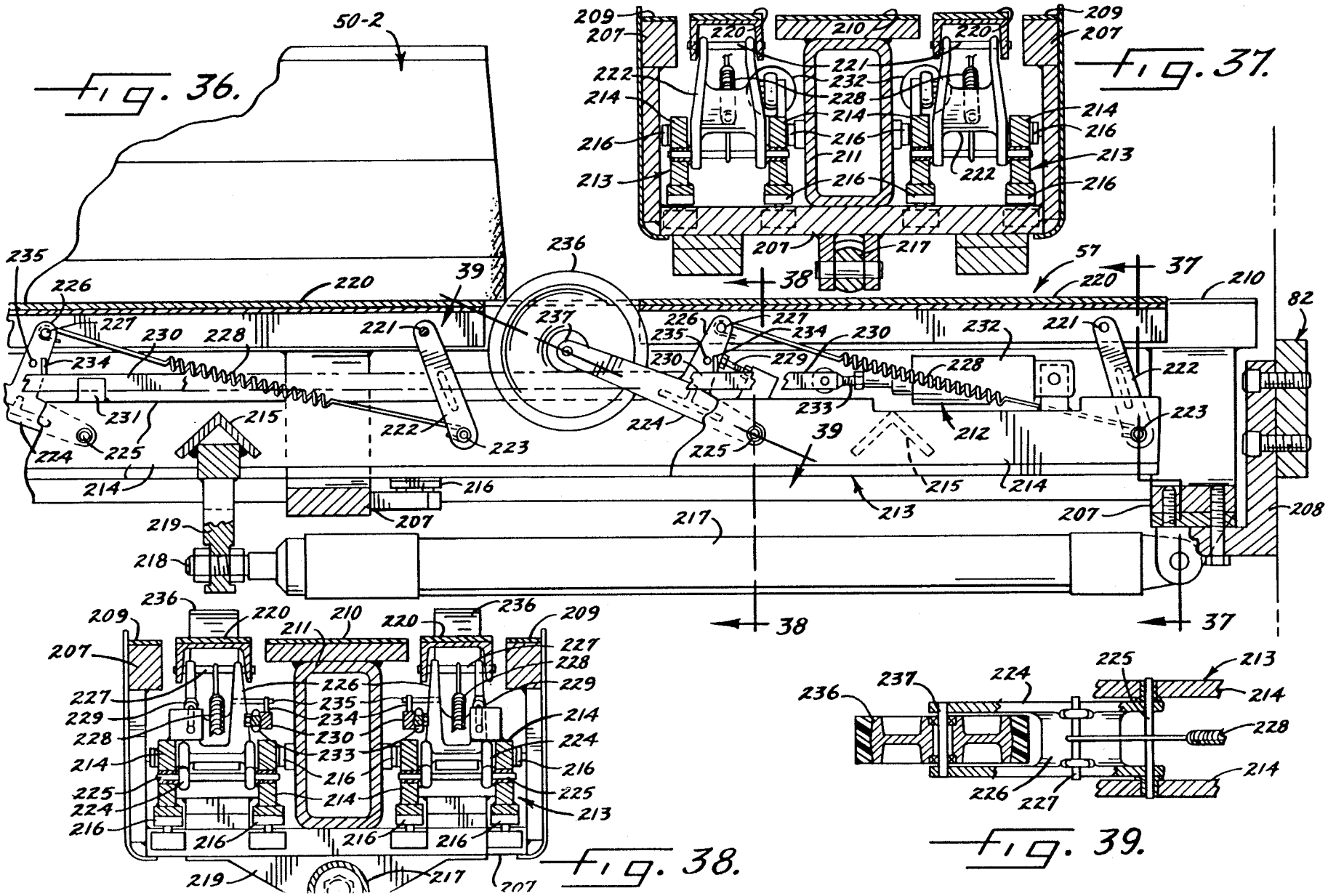
FIG. 36 is a fragmentary cross-sectional view of the transfer conveyor, the view being an enlarged view taken substantially along the line 36—36 of FIG. 43.
FIGS. 37, 38 and 39 are enlarged fragmentary cross-sections taken substantially along the lines 37—37, 38—38 and 39—39, respectively, of FIG. 36.
Figure 40:
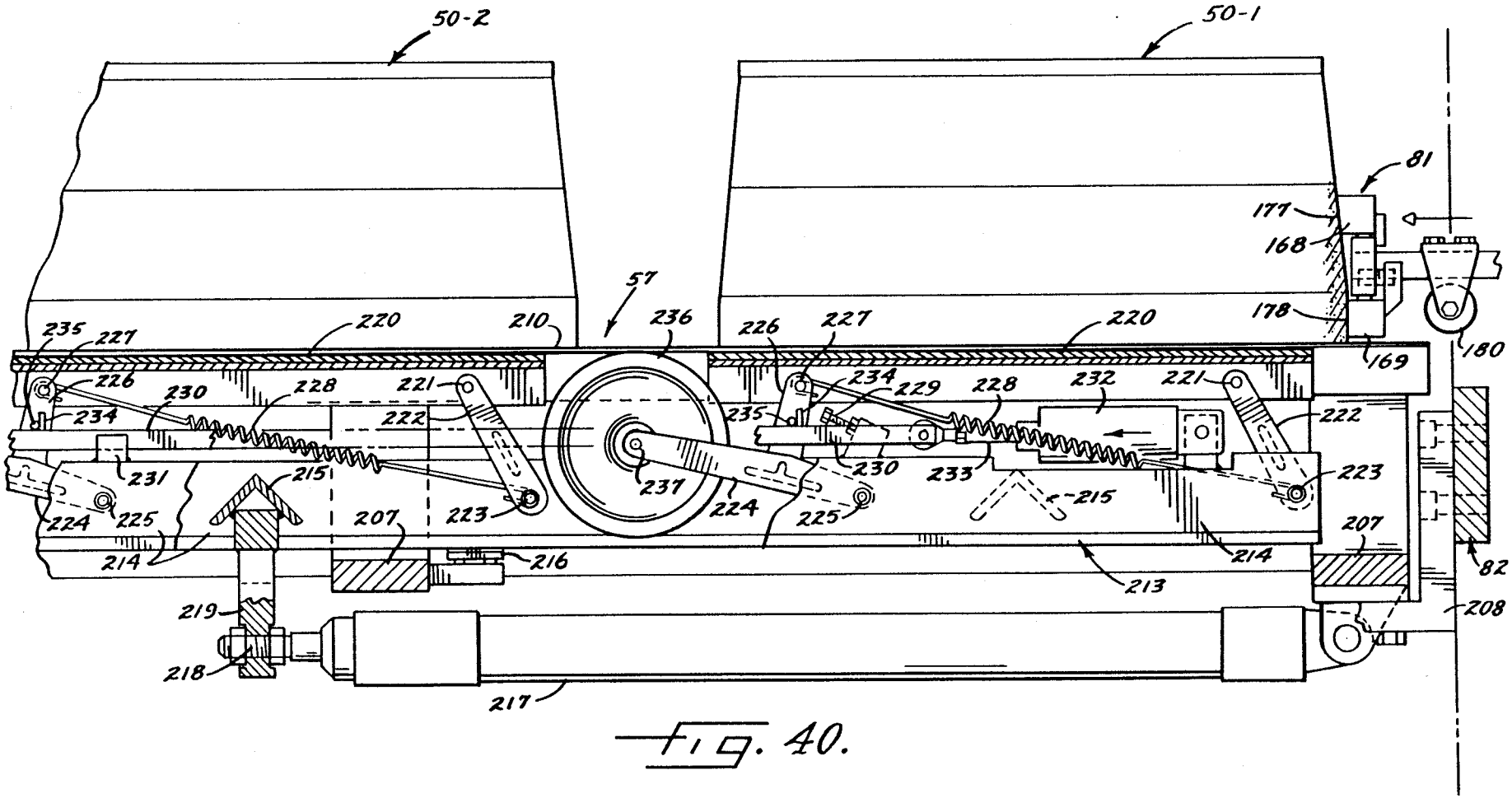
FIG. 40 is an enlarged view similar to FIG. 36 but shows certain parts of the conveyor in moved positions.
Figure 41:
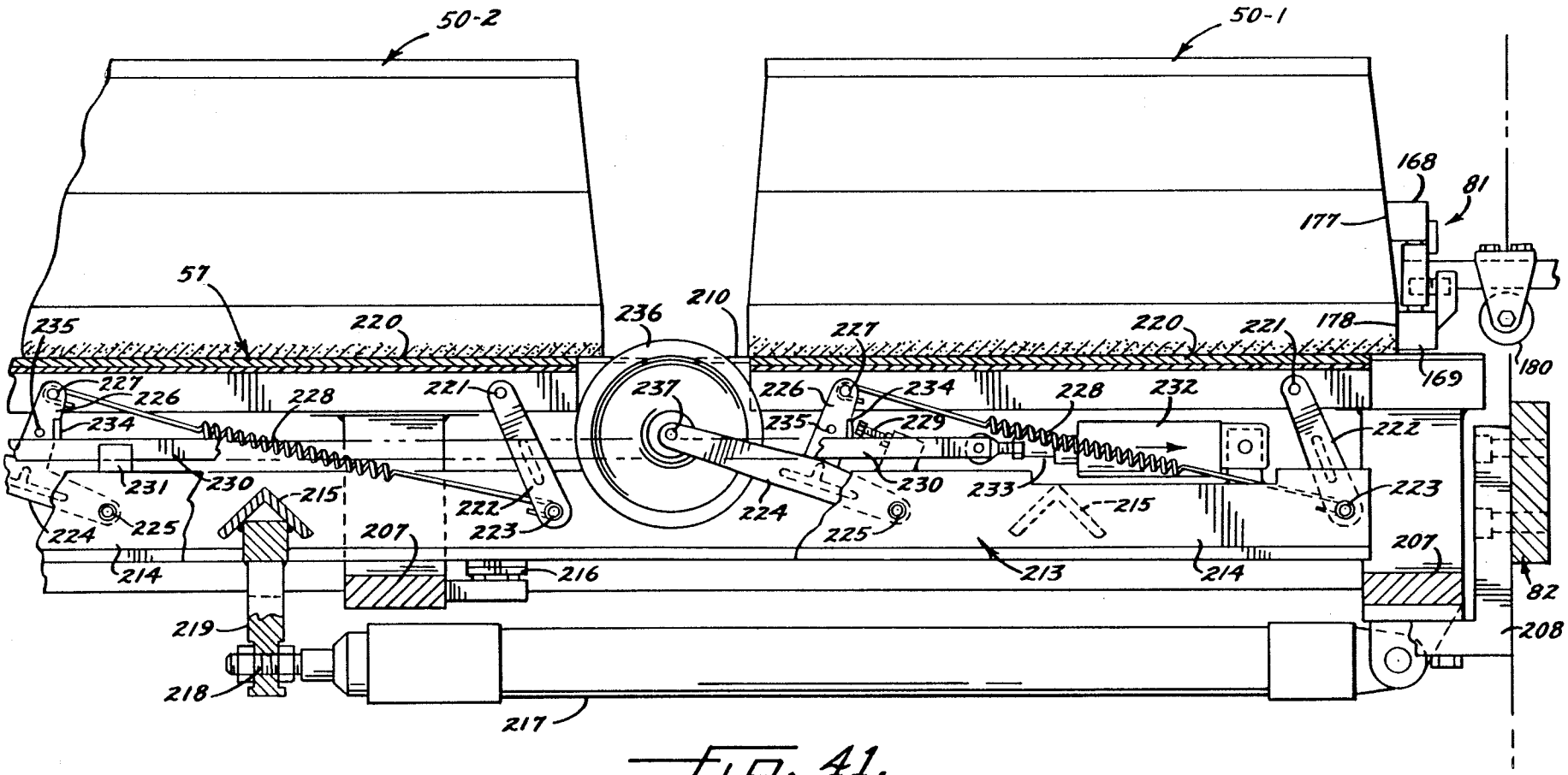
FIG. 41 is a view similar to FIG. 40 but shows the parts of the conveyor in position to advance the molds.

Mounted on the frame 207 are two laterally extending, parallel and horizontal outboard rails 209 (FIG. 37). A somewhat wider center rail 210 is located between the outboard rails 209 and is supported by a beam 211 which is attached to the frame 207. The rails 209 and 210 define skids along which the molds 50 are advanced.

Mold indexing mechanisms 212 (FIGS. 36 and 37) are located between the center rail 210 and the outboard rails 209 and are operable to advance the molds 50 step-by-step along the rails without lifting the molds from the rails. The two indexing mechanisms are virtually identical and thus a description of one will suffice for both.

As shown in FIGS. 36 and 37, each indexing mechanism 212 includes a reciprocating shuttle 213 defined by two spaced bars 214 connected to one another at 215 and supported to slide laterally back and forth by antifriction pads or slippers 216 on the frame. Both shuttles are adapted to be reciprocated laterally by a hydraulic actuator 217 connected to the frame 207 and having a rod 218 connected to both shuttles by a mounting structure 219.

Supported by each shuttle 213 located between the center rail 210 and each outside rail 209 are four shoes 220 (FIGS. 36 to 39) which index the molds 50 step-by-step along the rails. The upstream end portion of each shoe 220 is pivotally connected at 221 to the upper end portion of an arm 222 whose lower end portion is pivotally connected by a pin 223 to the bars 214 of the shuttle 213. Spaced downstream from each arm 222 is a lever 224 having a lower end portion connected pivotally to the bars 214 at 225. An arm 226 is formed integrally with each lever 224 between the ends thereof and includes an upper end portion which is connected pivotally to the downstream end portion of the associated shoe 220 by a pin 227. Stretched between the pins 223 and 227 is a contractile spring 228 which urges the lever 224 clockwise about the pivot 225. Clockwise swinging of the lever 224 is limited by virtue of the arm 226 engaging a fixed stop 229 on one of the bars 214 of the shuttle 213.

By virtue of the springs 228, the four shoes 220 are urged clockwise about the pivots 223 and 225 and are urged upwardly. When each shoe is fully raised, its upper surface is spaced a predetermined distance (e.g., 0.080") above the rails 209 and 210 (see FIGS. 37 and 38).

The elevation of the shoes 220 of each indexing mechanism 212 is controlled by a slide bar 230 (FIG. 36) which is guided at 231 for back and forth sliding on the bars 214 of the shuttle 213. A hydraulic actuator 232 is supported by each shuttle and includes a rod 233 which is connected to the upstream end portion of the slide bar. Upwardly extending pins 234 are secured to and are spaced along each slide bar 230 and are adapted to engage pins 235 attached to and extending horizontally from the arms 226 of the levers 224.

As shown in FIG. 1, the rails 209 and 210 are sufficiently long to define spaced stations for five molds 50-1 through 50-5. While there are five mold stations, there is only four sets of indexing shoes 220. The upstream set of shoes is adapted to move between stations Nos. 1 and 2, the next set of shoes is adapted to move between stations Nos. 2 and 3, and the third set of shoes is adapted to move between stations Nos. 3 and 4 and the last set of shoes is adapted to move between stations Nos. 4 and 5. Molds in station No. 5 are adapted to be removed from the conveyor 57 in a manner to be described subsequently.

FIG. 36 shows the condition of the conveyor 57 when shoes 220 are positioned in stations Nos. 1 through 4, when there is a mold 50-2 on the shoes in station No. 2 and when station No. 1 is empty. Under these circumstances, the rod 218 of the actuator 217 is retracted so as to locate the shuttles 213 in an extreme upstream position. In addition, the rods 233 of the actuators 232 are retracted so as to hold the slide bars 230 in retracted positions. As a result, the vertical pins 234 on the slide bars are spaced upstream from the horizontal pins 235 on the arms 226 of the levers 224. The springs 228 urge the levers 224 clockwise about the pivots 225 and, in the case of the levers in station No. 1, the arms 226 engage the stops 229 so as to limit clockwise pivoting of such levers.

By virtue of the springs 228 in empty station No. 1 (FIG. 36), the shoes 220 of that station are urged upwardly to a fully raised position in which the shoes are above the rails 209 and 210. The shoes 220 in station No. 2 also are urged upwardly but, because of the weight of the mold 50-2, those shoes are stopped in an active position in which the tops of the shoes are flush with the tops of the rails 209 and 210 and engage the underside of the mold. The mold 50-2 is too heavy to be raised from the rails by the shoes and the force of the springs 228 but the springs do cause a substantial lifting force to be applied to the mold and thus significantly reduce the downward force exerted by the mold on the rails.

Assume that the conveyor 57 is conditioned as shown in FIG. 36 and that mold 50-1 is ready to be shoved laterally off of the lower squeeze head 77 and onto the conveyor by the pusher 81 on the drag flask 64. Prior to the mold being shoved by the pusher, the rods 233 of the actuators 232 are extended to shift the slide bars 230 in a downstream direction. As a result, the pins 234 on the slide bars 230 engage the pins 235 on the arms 226 and force the levers 224 to swing counterclockwise about the pivots 225. This lowers all of the shoes 220 to an inactive position (see FIG. 40) in which the tops of the shoes are spaced a predetermined distance (e.g., ⅛") below the tops of the rails 209 and 210. As a result, the shoes in station No. 1 clear the rails so as to enable mold 50-1 to be shoved onto the rails without the downstream end of the mold striking the upstream ends of the shoes in station No. 1.

After mold 50-1 has been shoved into station No. 1, the rods 233 of the actuators 232 are retracted to shift the slide bars 230 upstream and pull the pins 234 away from the pins 235. By virtue thereof, the levers 224 are released to the action of the springs 228. Accordingly, the springs pivot the levers 224 clockwise to cause the shoes 220 to move upwardly into engagement with the underlying molds (see FIG. 41). As explained previously, the shoes tend to lift the molds off of the rails 209 and 210 and thus reduce the friction between the molds and the rails.

Figure 42:
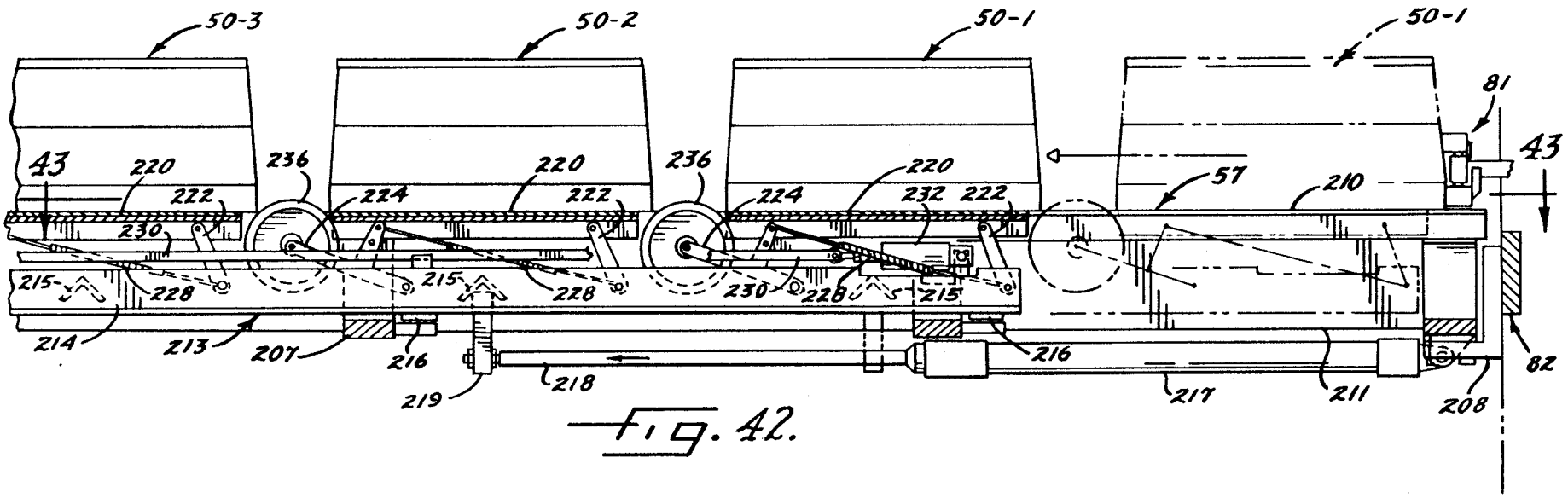
FIG. 42 is a cross-sectional view showing the conveyor after the molds have been advanced one step from the position shown in FIG. 41.
Figure 43:
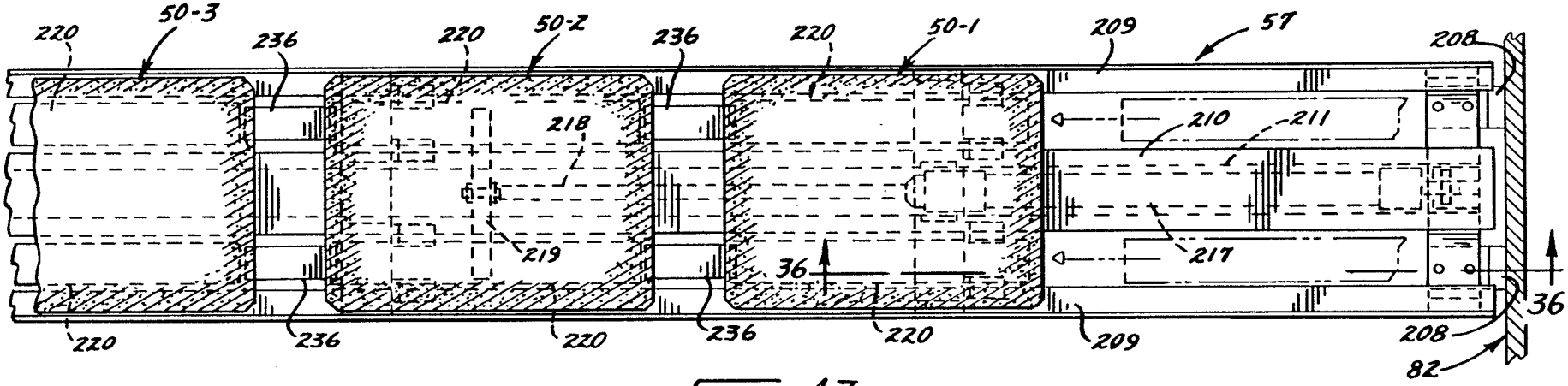
FIG. 43 is a fragmentary top plan view of the conveyor as seen along the line 43—43 of FIG. 42.

The rod 218 of the actuator 217 then is extended to shift the shuttles 213 and the shoes 220 through an active stroke in a downstream direction. As an incident thereto, each mold 50 is advanced by its underlying shoes from an upstream station to the most nearly adjacent downstream station. This is clearly illustrated in FIG. 42 where mold 50-1 is shown in phantom lines prior to being shifted out of station No. 1 and is shown in solid lines after having been advanced to station No. 2. FIG. 42 also shows molds 50-2 and 50-3 as having been advanced to stations Nos. 3 and 4, respectively. As the molds advance, any frictional drag between the molds and the shoes tends to pivot the arms 222 and the levers 224 clockwise so as to cause the shoes to exert an even greater lifting force on the molds.

Figure 44:
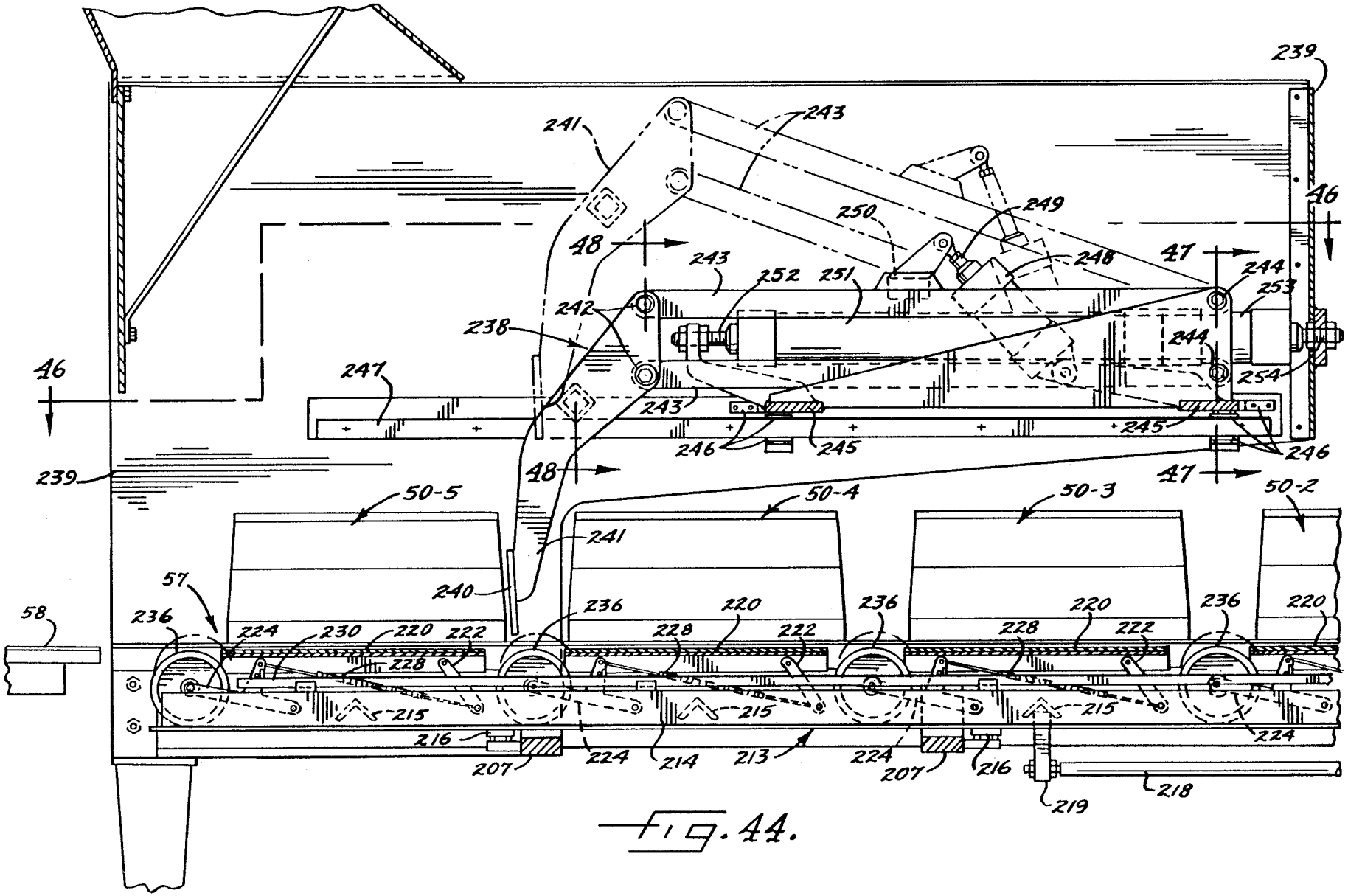
FIG. 44 is an enlarged fragmentary cross-section taken substantially along the line 44—44 of FIG. 1.

Once the molds 50 have been advanced one step, the rods 233 of the actuators 232 are extended to cause the pins 234 to engage the pins 235 so as to swing the levers 224 counterclockwise and shift the shoes 220 downwardly to their lowered positions in which the shoes clear the molds (see FIG. 44). The rod 218 of the actuator 217 then is retracted to shift the shuttles 213 and the shoes 220 in an upstream direction and through a return stroke. As a result, the shoes are returned reversely to their original stations for the start of another cycle. Since, in most instances, the rods 233 of the cylinders 232 will be in retracted positions upon return of the shoes to their original stations, the next cycle may be initiated simply by extending the rods 233 after the pusher 81 has shoved a new mold into station No. 1.

Importantly, the conveyor 57 includes feelers 236 which disable the indexing action of any given set of shoes 220 in the event that the mold 50 immediately downstream of such set of shoes fails to advance when the shoes are indexed through their active stroke. Herein, the feelers 236 are in the form of wheels which are rotatably supported on the upper end portions of the levers 224 by pins 237. Normally, the upper peripheral portions of the wheels project upwardly above the rails 209 and 210 and are located between the molds 50 in adjacent stations.

Assume that molds 50 are located in all five stations of the conveyor 57 and that signals are sent to the actuator 217 and the actuators 232 to initiate an indexing cycle. Assume further that a downstream delay or malfunction has resulted in the mold 50-5 in station No. 5 being left on the conveyor instead of being transferred to the turntable 58. Under these circumstances and in the absence of the wheels 236, an indexing stroke would cause mold 50-4 to run into mold 50-5, would cause mold 50-3 to run into mold 50-4 and so on. By virtue of the wheels, however, collisions are prevented. If a mold is located in station No. 5 at the start of an index stroke, the wheels 236 at the downstream ends of the shoes 220 in station No. 4 will first engage the upstream end of such mold and then will be cammed beneath the mold. As a result, the wheels 236 cause the levers 224 in station No. 4 to pivot counterclockwise and lower the shoes away from mold 50-4. That mold, therefore, remains in station No. 4 even though the shoes proceed to move downstream through an index stroke. By the same token, various upstream wheels are cammed beneath the preceding molds and thus disable their shoes so that no molds advance.

Accordingly, it will be apparent that the wheels 226 prevent collisions between adjacent molds 50. As long as there is an advance of a mold in a station immediately downstream of a given set of wheels, the wheels permit the immediately succeeding mold to advance. But, if any downstream mold fails to advance, the shoes for advancing the immediately succeeding mold are disabled.

Provision is made of a novel pushing mechanism 238 for shoving molds 50-5 from the downstream end portion of the conveyor 57 and onto the turntable 58. The pushing mechanism is particularly characterized by its ability to move clear of a mold 50 which just recently has been moved onto the turntable by the mechanism and by its ability to avoid interference with the next mold 50-4 being shifted to the end portion of the conveyor as a result of the shoes 220 indexing from station No. 4 to station No. 5.

More specifically, the pushing mechanism 238 is enclosed in a housing 239 which is located above the downstream end portion of the conveyor 57. The mechanism comprises a generally upright pusher pad 240 which is carried on the lower ends of two spaced arms 241. The upper end portions of the arms are pivotally connected at 242 to the downstream end portions of four links 243 which form a parallelogram linkage. At their rear end portions, the links are pivotally connected at 244 to a slide 245 which is supported by slippers 246 to move along rails 247 attached to the side walls of the housing 239.

A hydraulic actuator 248 with a rod 249 is connected between the slide 245 and a bar 250 which extends between the downstream end portions of the upper links 243. When the rod 249 is extended, the links 243 are pivoted upwardly to raise the pusher pad 240 between an active position shown in solid lines in FIG. 44 to an inactive position shown in phantom lines. When the pad is in its active position, it is located in opposing relation with the upstream end of a mold 50-5 in station No. 5 of the conveyor 57. Upward swinging of the pad to its inactive position causes the pad to raise well above the molds.

The pushing mechanism is completed by a hydraulic actuator 251 having a rod 252 connected to the slide 245. A second and much shorter hydraulic actuator 253 is connected in end-to-end relation with the actuator 251 and has its rod 254 attached to the housing 239.

Assume that a mold 50-5 is in station No. 5 of the conveyor 57 and that the pusher pad 240 is in its raised, inactive position shown in phantom lines in FIG. 44. A cycle is initiated by operating the actuator 248 to extend its rod 249 and swing the pad downwardly to its active position in spaced opposing relation with the upstream end of the mold as shown in solid lines in FIG. 44. During such swinging, the pad moves downwardly between the molds 50-4 and 50-5.

Figure 45:
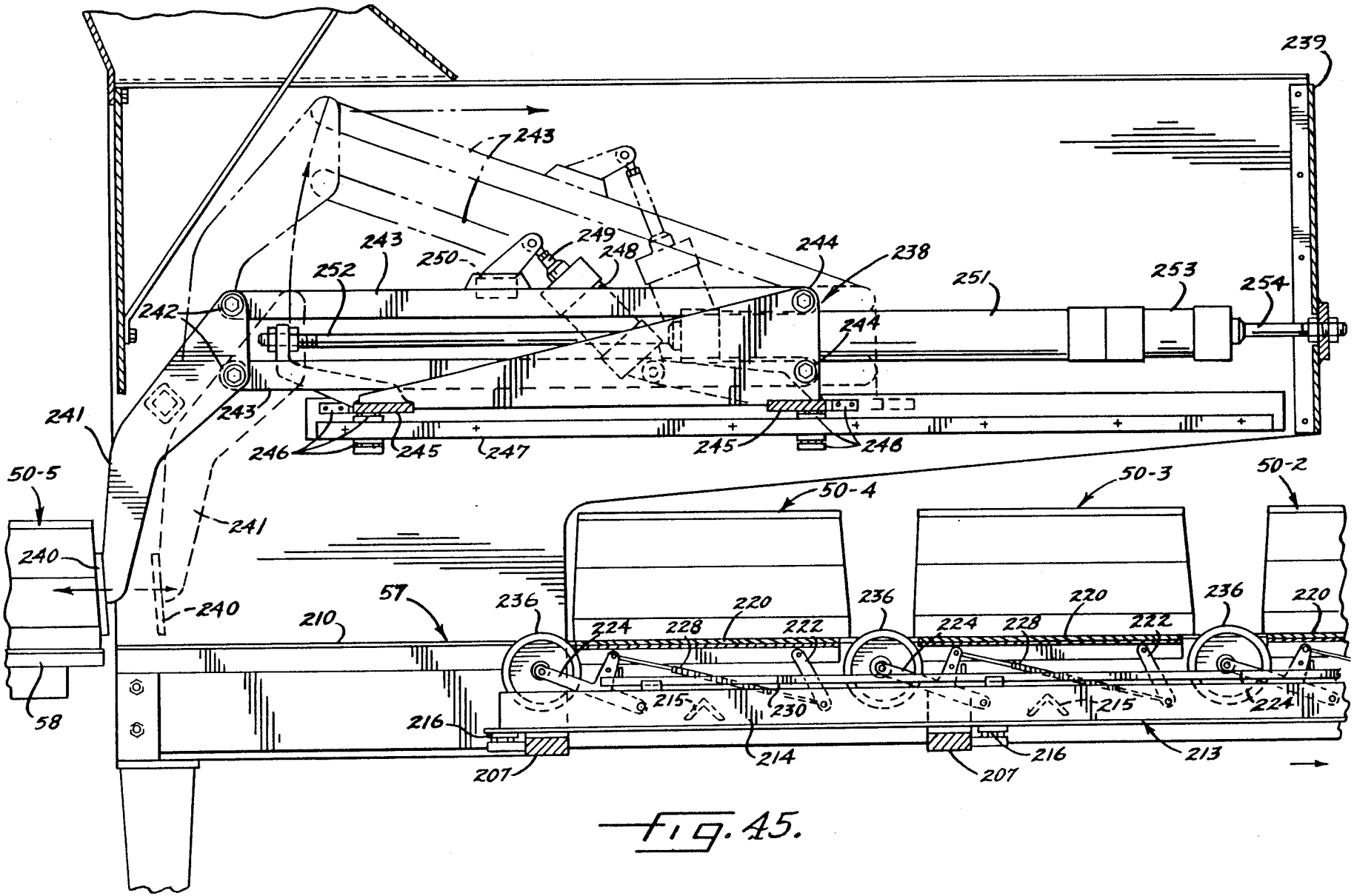
FIG. 45 is a view similar to FIG. 44 but shows certain parts in moved positions.
Figure 46:
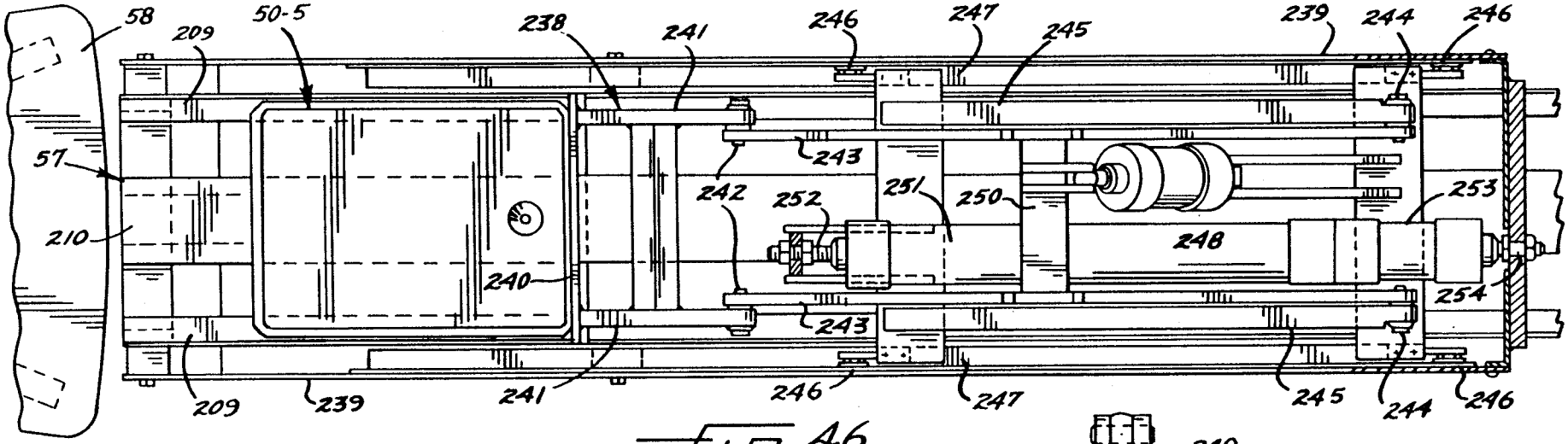
FIG. 46 is a top plan view of apparatus shown in FIG. 44, the view being taken along the line 46—46 of FIG. 44.
Figure 48:
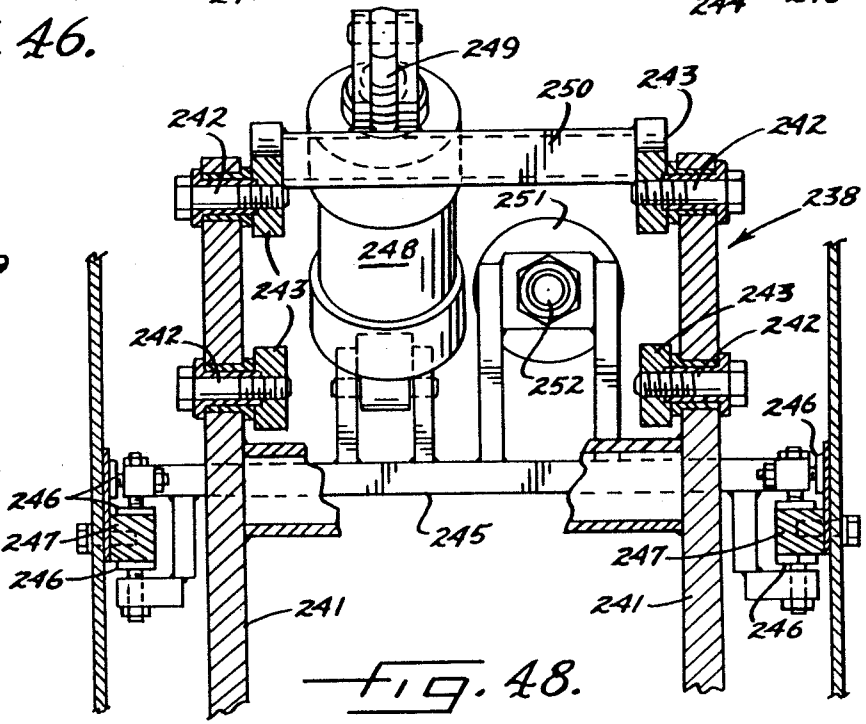
FIGS. 47 and 48 are enlarged fragmentary crosssections taken substantially along the lines 47—47 and 48—48, respectively, of FIG. 44.
Figure 47:
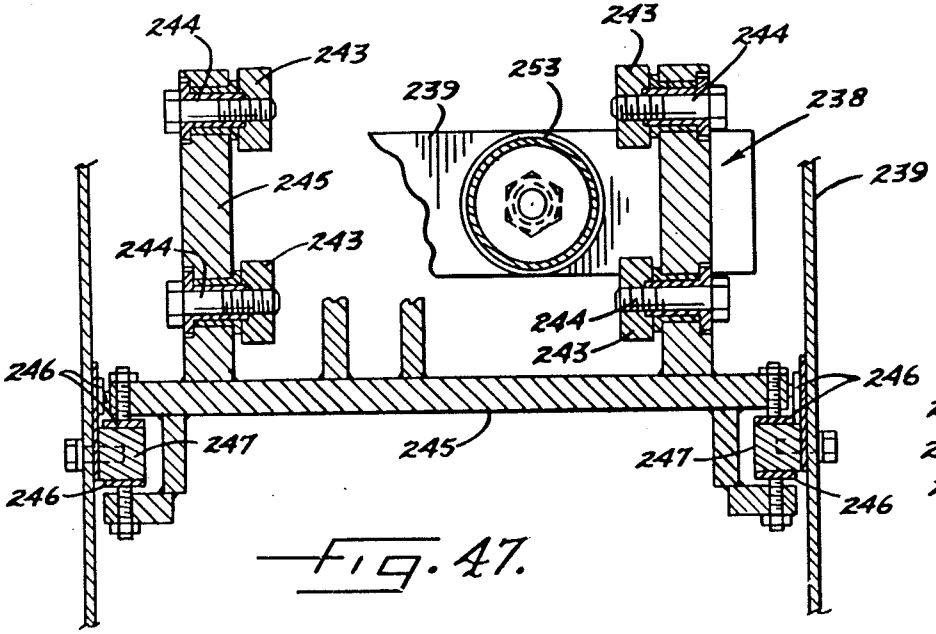

Thereafter, both actuators 251 and 253 are operated to extend their rods 252 and 253, respectively, as shown in FIG. 45. As a result, the slide 247 is moved in a downstream direction and the pusher 240 is moved through an active stroke of significant length so as to shove the mold 50-5 from the conveyor 57 to the turntable 58. Once the pusher has been advanced through its full active stroke, the actuator 253 is operated so as to retract its rod 254. This causes the pusher 240 to retract from the mold 50-5 through a back-up stroke which is significantly shorter in length than the active stroke. As a result, the pusher 240 is pulled clear of the mold 50-5 to the dashed line position of FIG. 45 but is not retracted so far as to interfere with the movement of the mold 50-4 advancing into station No. 5 of the conveyor 57.

Once the pusher 240 has been pulled away from the mold 50-5, the pusher is free to move upwardly without damaging the mold. Accordingly, the rod 249 of the actuator 248 is extended to swing the pusher upwardly to the position shown in phantom lines in FIG. 45. Thereafter, the rod 252 of the actuator 251 is retracted to pull the slide 245 through a return stroke in an upstream direction and thereby return the pusher to the position shown in phantom in FIG. 44. The length of the return stroke is equal to the difference between the length of the active stroke and the length of the back-off stroke.

Accordingly, the pusher 240 is moved in such a manner that the pusher pulls clear of the mold 50-5 after shoving the mold onto the turntable 58 but does not interefere with the advance of the following mold 50-4. Thus, an uninterrupted flow of molds may be established and maintained.

I claim:

1. A matchplate molding machine comprising a molding flask for making a mold from sand, a sand magazine spaced vertically from said flask, said magazine being movable laterally relative to said flask between a receiving position in which the magazine is spaced laterally from the flask and a delivery position in which the magazine is alined vertically with the flask, said magazine being loaded with sand when in said receiving position and being conditioned to discharge such sand into said flask when in said delivery position, an air plenum spaced vertically from and alined vertically with said flask, said magazine being located between said air plenum and said flask when said magazine is in said delivery position, means for supplying pressurized air to said plenum when said magazine is in said delivery position, vertically opening ports in said plenum for directing pressurized air into said magazine thereby to blow sand from the magazine and into said flask, means mounting said plenum for vertical movement between active and retracted positions, said plenum sealing against said magazine when in said active position thereby to enable the pressurized air to blow the sand from said magazine, said plenum being spaced vertically from said magazine when in said retracted position thereby to enable the magazine to move laterally between said receiving and delivery positions, and means for selectively shifting said plenum vertically between said active and retracted positions.

2. A matchplate molding machine as defined in claim 1 further including a fixed support spaced vertically from said air plenum, said means for moving said plenum toward said active position comprising a series of pockets located between said support and said plenum, a piston located in each of said pockets, and means for periodically introducing pressurized air into said pockets to cause said pistons to force said plenum away from said support and toward said magazine.

3. A matchplate molding machine as defined in claim 2 in which said pockets are formed in said support, said means for shifting said plenum to said retracted position comprising springs located between said support and said plenum and acting in a direction opposite to said pistons.

4. A matchplate molding machine comprising a molding flask for making a mold from sand, a sand magazine spaced vertically from said flask, said magazine being movable laterally relative to said flask between a receiving position in which the magazine is spaced laterally from the flask and a delivery position in which the magazine is alined vertically with the flask, said magazine being loaded with sand when in said receiving position and being conditioned to discharge such sand into said flask when, in said delivery position, an air plenum spaced vertically from said flask and movable with said magazine, vertically opening ports in said plenum for directing pressurized air into said magazine thereby to blow sand from the magazine and into said flask, and means for supplying pressurized air to said plenum when said plenum is in said delivery position, said means being adapted to be operably coupled to said plenum when the plenum is in said delivery position and being adapted to be uncoupled from said plenum to permit the plenum to shift to said receiving position.

5. A matchplate molding machine as defined in claim 4 in which said means comprise a header adapted to be connected to a source of pressurized air, and means for moving said header vertically into and out of coupling relation with said plenum.

6. A matchplate molding machine comprising a molding flask for making a mold from sand, a sand magazine spaced vertically from said flask and movable upwardly and downwardly relative to said flask, said magazine being movable laterally relative to said flask between a receiving position in which the magazine is spaced laterally from said flask and a delivery position in which the magazine is alined vertically with the flask, an upright sand chute, said magazine being alined vertically with said chute when said magazine is in said receiving position, a gate, supporting means mounting said gate for lateral movement between a closed position in which the gate closes the chute and an open position in which the gate opens the chute, said magazine being spaced laterally from said supporting means when said magazine is in said delivery position and when said gate is in said closed position, means attached to said magazine for moving said magazine between said delivery position and said receiving position, said magazine engaging said supporting means after said magazine has been moved through a predetermined distance toward said receiving position and thereafter pushing said supporting means laterally in one direction to cause said gate to move from said closed position to said open position, and means for coupling said magazine to said supporting means and causing said magazine to pull said supporting means laterally in the opposite direction and cause said gate to return from said open position to said closed position as said magazine initially is moved from said receiving position toward said delivery position, said coupling means uncoupling said magazine from said supporting means after said gate has reached said closed position and thereafter permitting said magazine to move through said predetermined distance to said delivery position without pulling said supporting means.

7. A matchplate molding machine as defined in claim 6 in which said coupling means comprise a vacuum pad located between said magazine and said supporting means, said vacuum pad being connected to and carried by one of said magazine and supporting means, and means for selectively applying vacuum to and releasing vacuum from said pad thereby to cause said pad to couple and uncouple, respectively, said magazine and said supporting means.

8. A matchplate molding machine as defined in claim 7 in which said vacuum pad is connected to and is carried by said supporting means.

* * * * *